US005135843A

United States Patent [19]

Takamuki et al.

[11] Patent Number: 5,135,843

[45] Date of Patent: Aug. 4, 1992

[54] SILVER HALIDE PHOTOGRAPHIC ELEMENT

[75] Inventors: Yasuhiko Takamuki; Takatoshi Yamada; Takeshi Habu; Toshiharu Nagashima, all of Hino, Japan

[73] Assignee: Konica Corporation, Tokyo, Japan

[21] Appl. No.: 558,577

[22] Filed: Jul. 27, 1990

[30] Foreign Application Priority Data

Jul. 28, 1989 [JP] Japan ..... 1-197193
Oct. 16, 1989 [JP] Japan ..... 1-268318

[51] Int. Cl.[5] ..... G03C 1/82

[52] U.S. Cl. ..... 430/528; 430/523; 430/526; 430/527

[58] Field of Search ..... 430/523, 526, 527, 528, 430/624

[56] References Cited

U.S. PATENT DOCUMENTS 4,225,665 9/1980 Schadt, III ..... 430/529
4,294,739 10/1981 Upson et al. ..... 430/528
4,308,332 12/1981 Upson et al. ..... 430/528
4,810,624 3/1989 Hardam et al. ..... 430/528
4,908,155 3/1990 Leemans et al. ..... 430/528
4,960,688 10/1990 Sakanoue et al. ..... 430/624

FOREIGN PATENT DOCUMENTS 32456 7/1981 European Pat. Off. .
2029978 3/1980 United Kingdom .
2078235 1/1982 United Kingdom .

*Primary Examiner*—Jack P. Brammer
*Attorney, Agent, or Firm*—Jordan B. Bierman

[57] ABSTRACT

The improved silver halide photographic material comprises a support having an antistatic coating thereon that contains a water-soluble conductive polymer, hydrophobic polymer particles and a curing agent which is a bifunctional ethylene oxide type curing agent that is to be cured by exposure to electron beams or X-rays. This silver halide photographic material may contain a tetrazolium compound or a hydrazine compound in order to prevent desensitization due to aging. At least one hydrophilic colloidal layer may be provided on the antistatic coating, which colloidal layer contains an epoxy curing agent having a hydroxy group.

7 Claims, No Drawings

SILVER HALIDE PHOTOGRAPHIC ELEMENT

BACKGROUND OF THE INVENTION

This invention relates to a silver halide photographic material having an antistatic coating.

Plastic film supports generally have a great tendency to experience static buildup, which in many cases have put various limitations on the use of these supports. To take silver halide photographic materials as an example, plastic film supports such as polyethylene terephthalate films are commonly used but they often experience static buildup, particularly at low temperatures in the winter season. Provisions against this static buildup problem bear particular importance to recent practices in the photographic industry including high-speed coating of high-sensitivity photographic emulsions and exposure of high-sensitivity photographic materials in automatic printers.

When static charge builds up on photographic materials, occasional discharging produces static marks or foreign matters such as dust particles are electrostatically deposited to produce surface defects such as pinholes which cause substantial deterioration of the quality of photographic materials. Correcting these defects results in considerable decrease in the operational efficiency. Under these circumstances, antistatic agents are customarily used in photographic materials and recently employed antistatic agents include fluorine-containing surfactants, cationic surfactants, amphoteric surfactants, surfactants or high-molecular weight compounds containing polyethylene oxide groups, and polymers having sulfonic acid or phosphoric acid groups in the molecule.

A practice that has recently gained increasing popularity in the art is to adjust triboelectric series with fluorine-containing surfactants or to provide improved conductivity by means of conductive polymers. For example, Unexamined Published Japanese Patent Application Nos. 91165/1974 and 121523/1974 disclose the application of ionic polymers having a dissociative group in the backbone chain of the polymer.

These prior art techniques, however, have the problem that their antistatic capability is markedly reduced by development and subsequent processing. This may be because the capability of antistatic agents is lost as they pass through a development step using alkalis, a fixing step under acidic conditions, and subsequent steps including washing. Hence, if processed films such as printing light-sensitive materials are subjected to a printing process, serious surface defects such as pinholes will occur on account of electrostatic deposition of dust particles. In order to deal with this problem, Unexamined Published Japanese Patent Application Nos. 84658/1980 and 174542/1986 have proposed an antistatic coating that is composed of a water-soluble conductive polymer having a carboxyl group, a hydrophobic polymer having a carboxyl group, and a polyfunctional aziridine. This approach insures that the capability of the antistatic coating is retained after photographic processing but it has been found that if a hydrophilic colloidal layer such as an antihalation layer is superposed on the antistatic coating, cracking occurs during storage to greatly impair the commercial value of the photographic material. Further, the antistatic coating has such poor adhesion to the overlying hydrophilic colloidal layer that the two layers will separate during development and subsequent photographic processing.

It has also been found that when supercontrasting agents such as tetrazolium or hydrazine compounds are used in silver halide photographic materials having this antistatic coating, the sensitivity of the photographic materials decreases with time during storage.

SUMMARY OF THE INVENTION

It is, therefore, an object of the present invention to provide a silver halide photographic material that will not experience deterioration in its antistatic capability even if it is subjected to development and other photographic processing.

Another object of the present invention is to provide a silver halide photographic material that will not crack during storage.

A further object of the present invention is to provide a silver halide photographic material having an antistatic coating with provided adhesion to hydrophilic colloidal layers.

Yet another object of the present invention is to provide a highly stable silver halide photographic material that will not undergo desensitization with time even if a supercontrasting agent such as a tetrazolium or hydrazine compound is used.

The first, second and fourth objects of the present invention can be attained by a silver halide photographic material comprising a support having at least one light-sensitive emulsion layer and an antistatic coating containing (1) a water-soluble conductive polymer, (2) hydrophobic polymer particles and (3) a curing agent, which curing agent is a bifunctional ethylene oxide type curing agent and is to be cured by exposure to electrons beams or X-rays.

The first, third and fourth objects of the present invention can be attained by a silver halide photographic material comprising a support having an antistatic coating containing (1) a water-soluble conductive polymer, (2) hydrophobic polymer particles and (3) a curing agent, and at least one light-sensitive emulsion layer, said photographic material having one or more hydrophilic colloidal layers containing gelatin as a substantial binder, at least one of said hydrophilic colloidal layers containing an epoxy curing agent having a hydroxy group.

The light-sensitive emulsion layer in the photographic material of the present invention desirably contains a hydrazine or tetrazolium compound.

DETAILED DESCRIPTION OF THE INVENTION

The water-soluble conductive polymer for use in the antistatic coating in the photographic material of the present invention may be a polymer having at least one conductive group selected from among a sulfonic acid group, a sulfate ester group, a quaternary ammonium salt group, a tertiary ammonium salt group, a carboxyl group and a polyethylene oxide group. Polymers having at least one of a sulfonic acid group, a sulfate ester group and a quaternary ammonium salt group are preferred. These water-soluble conductive polymers must contain conductive groups in an amount of at least 5 wt % per molecule of the polymer. The water-soluble conductive polymer may also contain a carboxyl group, a hydroxyl group, an amino group, an epoxy group, an aziridine group, an active methylene group, a sulfinic acid group, an aldehyde group or a vinylsulfone group.

Among these groups, a carboxyl group, a hydroxyl group, an amino group, an epoxy group, an aziridine group and an aldehyde group are preferred. These groups are preferably contained in an amount of at least 5 wt % per molecule of the polymer. The water-soluble conductive polymer generally has a molecular weight in the range of 3,000–100,000, with the range of 3,500–50,000 being preferred.

The water-soluble conductive polymer that can be used in the present invention may be exemplified by, but not limited to, the following compounds.

homopolymer

A-1

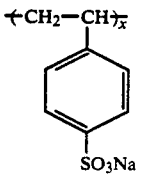

$\overline{M} \simeq 6 \times 10^4$ homopolymer

A-2

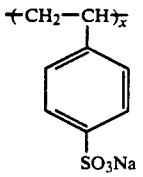

$\overline{M} \simeq 7 \times 10^4$

A-3

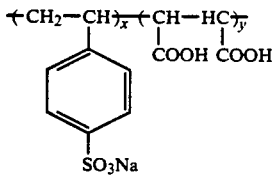

x:y = 67:34

$\overline{M} \simeq 5 \times 10^3$

A-4

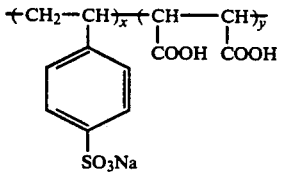

x:y = 50:50

$\overline{M} \simeq 1.2 \times 10^4$

A-5

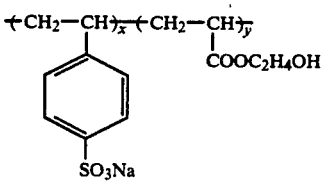

x:y = 70:30

$\overline{M} \simeq 5 \times 10^3$

-continued

A-6

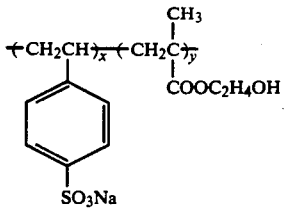

x:y = 90:10

$\overline{M} = 10^4$

A-7

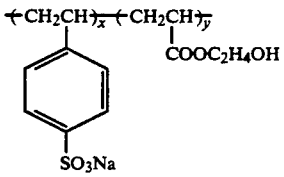

x:y = 60:40

$\overline{M} = 7 \times 10^3$

A-8

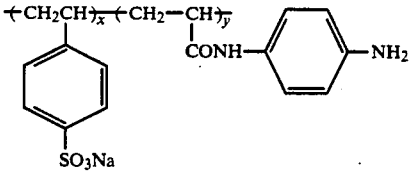

x:y = 90:10

$\overline{M} = 1.5 \times 10^4$

A-9

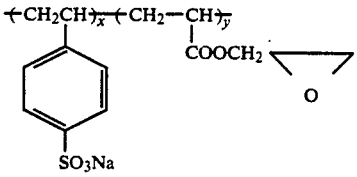

x:y = 60:40

$\overline{M} = 5 \times 10^3$

A-10

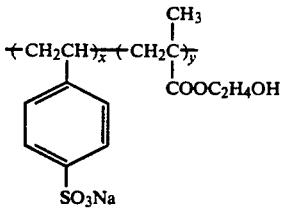

x:y = 90:10

$\overline{M} = 2 \times 10^4$

A-11

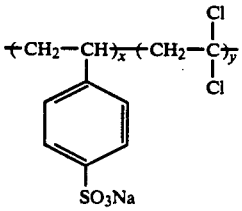

x:y = 97:3

$\overline{M} \simeq 3 \times 10^4$

-continued

A-12

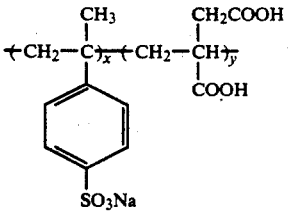

x:y = 98:2

$\overline{M} \simeq 5 \times 10^3$

A-13

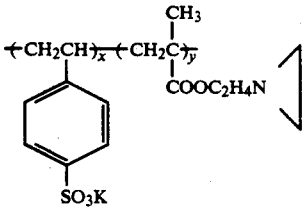

x:y = 60:40

$\overline{M} = 8 \times 10^3$

A-14

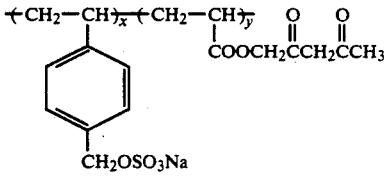

x:y = 95:5

$\overline{M} \simeq 2.5 \times 10^4$

A-15

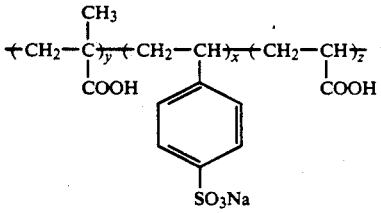

x:y:z = 80:19:1

$\overline{M} \simeq 5 \times 10^3$

A-16

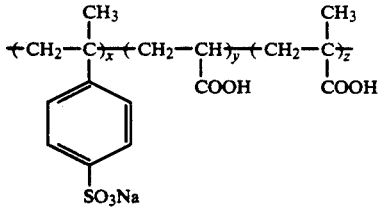

x:y:z = 70:28:2

$\overline{M} \simeq 6 \times 10^3$

A-17

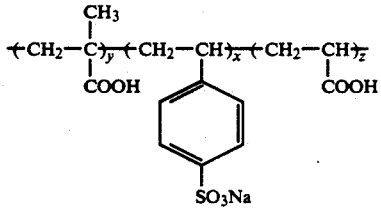

x:y:z = 85:13:2

$\overline{M} \simeq 8 \times 10^3$

-continued

A-18

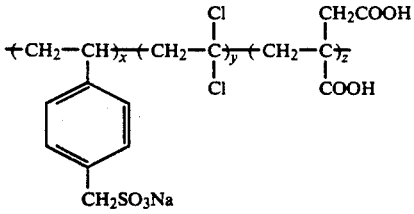

x:y:z = 80:16:4

$\overline{M} \simeq 10^4$

A-19

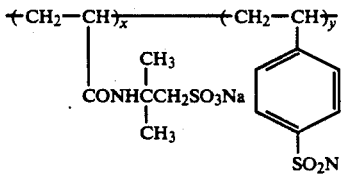

x:y = 90:10

$\overline{M} \simeq 3 \times 10^4$

A-20

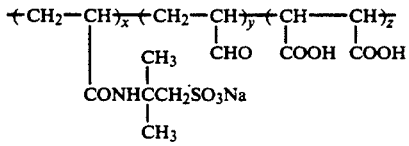

x:y:z = 85:10:5

$\overline{M} \simeq 1 \times 10^4$

A-21

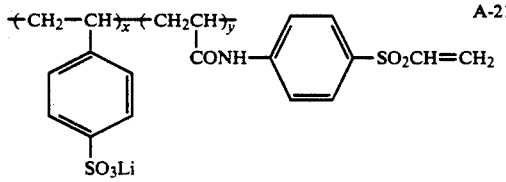

x:y = 90:10

$\overline{M} \simeq 6 \times 10^3$

A-22

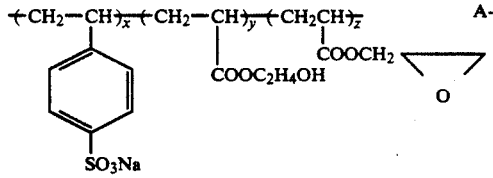

x:y:z = 80:10:10

$\overline{M} \simeq 1.5 \times 10^4$

A-23 dextran sulfate (degree of substitution = 2.0; $\overline{M} = 10^5$)

A-24

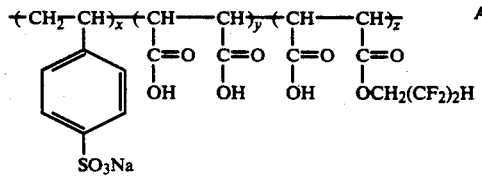

x:y:z = 50:40:10

$\overline{M} \simeq 10^5$

-continued

A-25

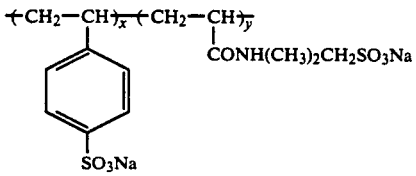

x:y = 80:20

$\overline{M} \simeq 5 \times 10^4$

A-26

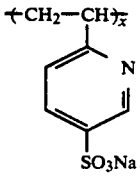

$\overline{M} \simeq 10^5$

A-27

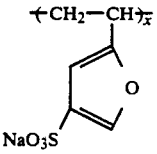

$\overline{M} \simeq 2 \times 10^4$

A-28

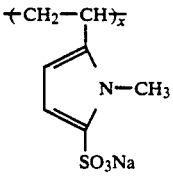

$\overline{M} \simeq 2 \times 10^4$

A-29

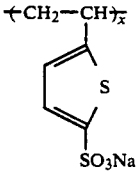

$\overline{M} \simeq 1.5 \times 10^5$

A-30

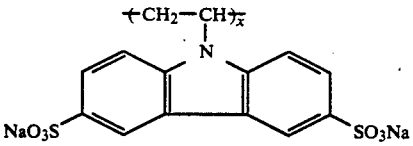

$\overline{M} \simeq 3 \times 10^5$

A-31

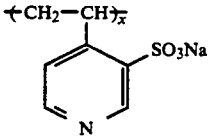

$\overline{M} \simeq 2.8 \times 10^5$

A-32

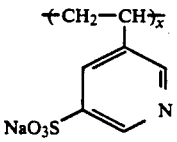

$\overline{M} \simeq 5 \times 10^4$

-continued

A-33

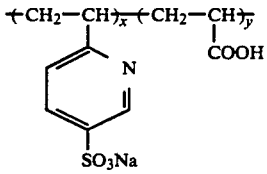

x:y = 60:40

$\overline{M} \simeq 8 \times 10^4$

A-34

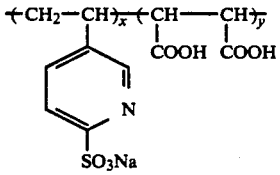

x:y = 70:30

$\overline{M} \simeq 5 \times 10^3$

A-35

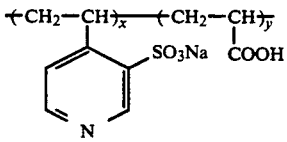

x:y = 80:20

$\overline{M} \simeq 5 \times 10^4$

A-36

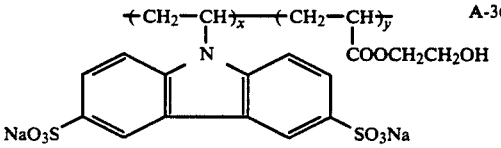

x:y = 75:25

$\overline{M} \simeq 4 \times 10^4$

A-37

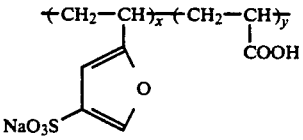

x:y = 80:20

$\overline{M} \simeq 6 \times 10^4$

A-38

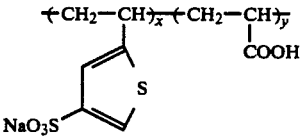

x:y = 90:10

$\overline{M} \simeq 4 \times 10^4$

A-39

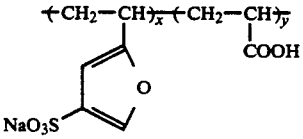

x:y = 55:45

$\overline{M} \simeq 2 \times 10^4$

-continued

A-40

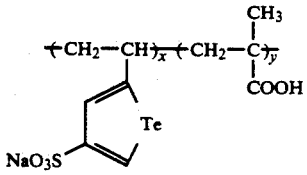

x:y = 90:10

$\overline{M} \simeq 6 \times 10^4$

A-41

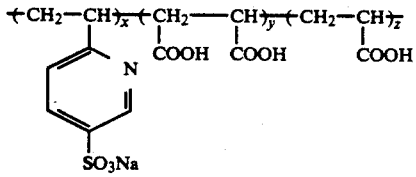

x:y:z = 80:10:10

$\overline{M} \simeq 10^4$

A-42

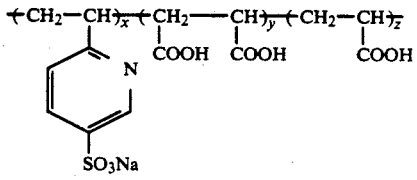

x:y:z = 70:25:5

$\overline{M} \simeq 3 \times 10^4$

A-43

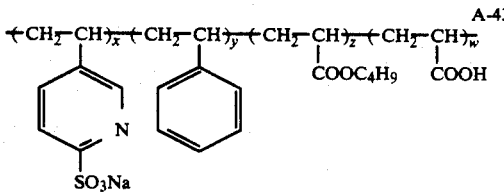

x:y:z:w = 60:30:8:2

$\overline{M} \simeq 5 \times 10^4$

A-44

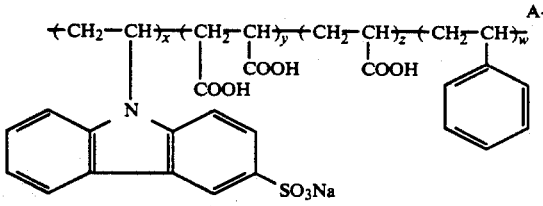

x:y:z:w = 50:30:10:10

$\overline{M} \simeq 6 \times 10^4$

A-45

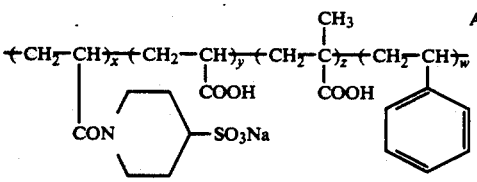

x:y:z:w = 40:30:20:10

$\overline{M} \simeq 5 \times 10^4$

A-46

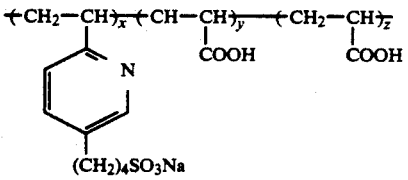

x:y:z = 60:30:10

$\overline{M} \simeq 3 \times 10^4$

A-47

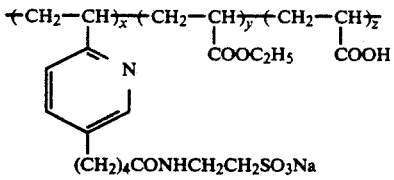

x:y:z = 80:5:15

$\overline{M} \simeq 5 \times 10^4$

A-48

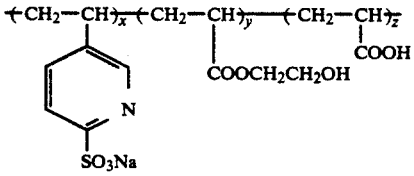

x:y:z = 55:35:10

$\overline{M} \simeq 3 \times 10^4$

A-49

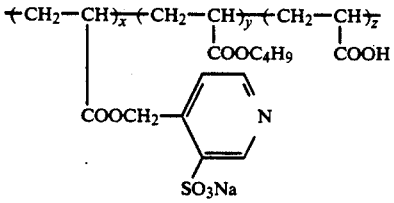

x:y:z = 50:10:40

$\overline{M} \simeq 6 \times 10^4$

A-50

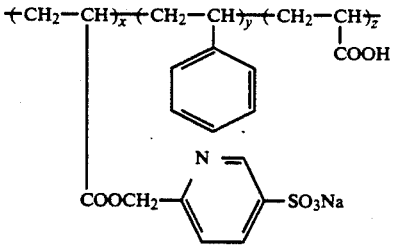

x:y:z = 60:10:30

$\overline{M} \simeq 6 \times 10^4$

In the above formulas A-1 to A-50, x, y, z and w each represents the mol % of the relevant monomer component, and $\overline{M}$ represents the average molecular weight (the term "average molecular weight" as used herein means the number average molecular weight).

The polymers enumerated above can be synthesized by polymerizing monomers that are either commercially available or obtainable in the usual manner. These compounds are incorporated in the antistatic coating in amounts that generally range from 0.01 to 10 g/m$^2$, preferably from 0.1 to 5 g/m$^2$.

These compounds may form a layer in admixtures with various hydrophilic or hydrophobic binders. Hydrophilic binders that can be used with particular advantage are gelatin and polyacrylamide. Other useful hydrophilic binders include colloidal albumin, cellulose acetate, cellulose nitrate, polyvinyl alcohol, hydrolyzed polyvinyl acetate and phthalated gelatin. Hydrophobic binders that can be used include polymers having molecular weights of at least $2 \times 10^4$ to $1 \times 10^6$ and may be exemplified by a styrene/butyl acrylate/acrylic acid terpolymer, a butyl acrylate/acrylonitrile/acrylic acid terpolymer, and a methyl methacrylate/ethyl acrylate/acrylic acid terpolymer.

The hydrophobic polymer particles to be incorporated in the antistatic coating in the photographic material of the present invention are contained in the form of a "latex" that is substantially insoluble in water. These hydrophobic polymer particles are obtained by polymerizing monomers selected from among any desired combinations of styrene, styrene derivatives, alkyl acrylates, alkyl methacrylates, olefinic derivatives, halogenated ethylene derivatives, acrylamide derivatives, methacrylamide derivatives, vinyl ester derivatives, acrylonitrile, etc. Preferred hydrophobic polymer particles are those which contain styrene derivatives, alkyl acrylates and alkyl methacrylates in amounts of at least 30 mol %, and those which contain these monomers in amounts of at least 50 mol % are particularly preferred.

Latices of these hydrophobic polymers can be formed by either one of the following two methods: i) emulsion polymerization and ii) dissolving solid hydrophobic polymer particles in a low-boiling solvent, forming a fine dispersion of the polymer particles, and then distilling off the solvent. Emulsion polymerization is preferred since it is capable of producing a latex of fine polymer particle of a uniform size.

Anionic and nonionic surfactants are preferably used in emulsion polymerization and, in the present invention, anionic and nonionic surfactants are used in amounts of no more than 10 wt % of the monomers. The excessive use of surfactants will make the antistatic coating cloudy and hence should be avoided.

Molecular weights of at least 3,000 will suffice for the hydrophobic polymer particles and the transparency of the conductive layer will be little affected by the difference in the molecular weight of the hydrophobic polymer if it is no less than 3,000.

Specific examples of the hydrophobic polymer that can be used in the present invention are listed below.

B-1

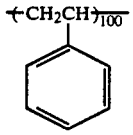

B-2

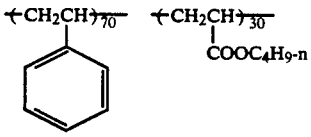

B-3

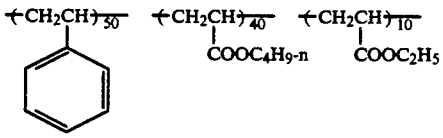

B-4

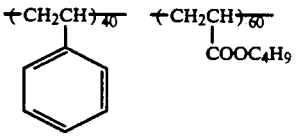

-continued

B-5

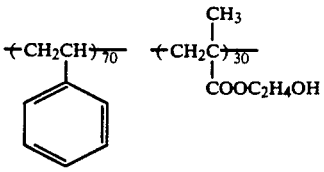

B-6

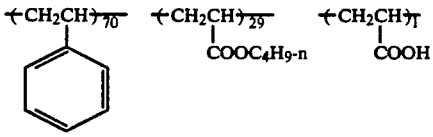

B-7

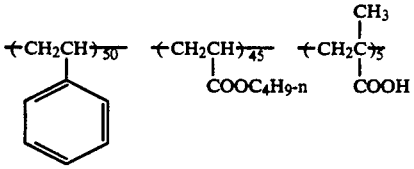

B-8

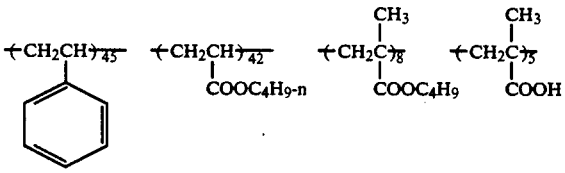

B-9

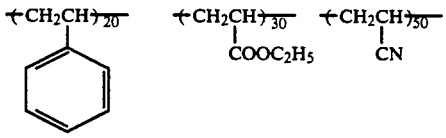

B-10

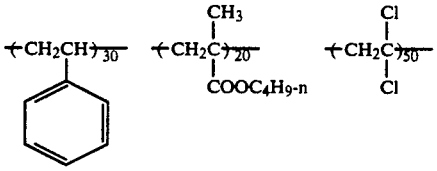

B-11

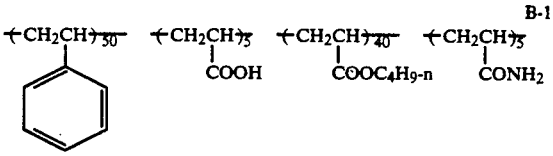

B-12

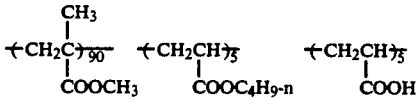

B-13

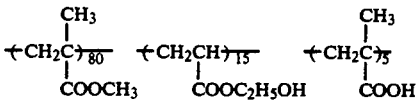

B-14

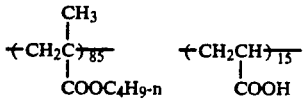

B-15

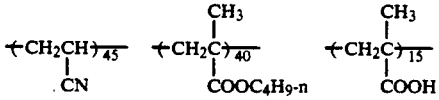

-continued

B-16

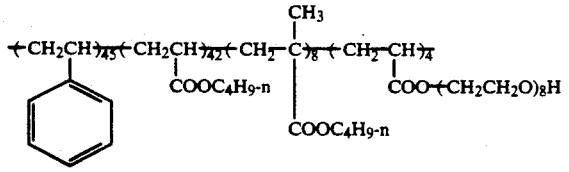

B-17

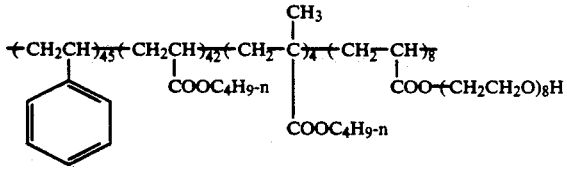

B-18

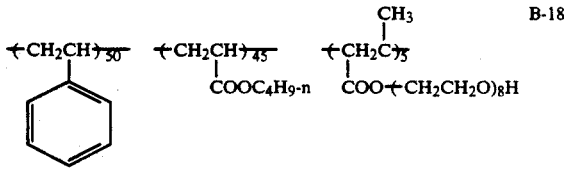

B-19

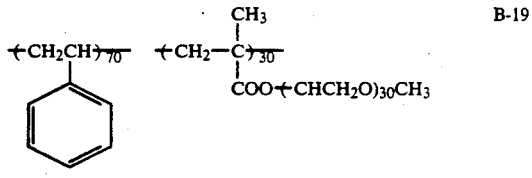

B-20

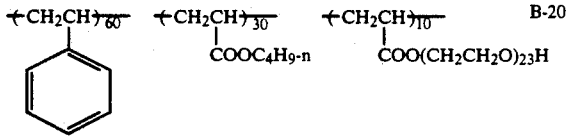

B-21

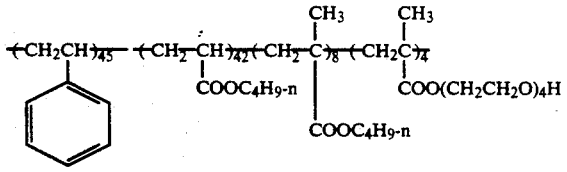

In the present invention, the antistatic coating is formed on a transparent support. All photographic transparent supports may be used but preferred examples are polyethylene terephthalate and cellulose triacetate films that are adapted to transmit at least 90% of visible light. These transparent supports can be prepared by methods that are well known to one skilled in the art. If desired, they may be blued by adding dyes in small amounts that will not substantially impair light transmission.

The supports to be used in the present invention may be coated with a subbing layer containing a latex polymer after corona discharge treatment. Corona discharge treatment is preferably performed to provide an energy of 1 mW–1 kW/m$^2$ per minute. In a particularly preferred case, supports coated with a subbing layer of polymer latex may be subjected to another corona discharge treatment before an antistatic coating is applied.

According to a preferred embodiment of the present invention, a bifunctional ethylene oxide type curing agent is used as a compound for curing the antistatic coating. Such a bifunctional ethylene oxide type curing agent is represented by the following general formula (C):

$$CH_2{=}CH{-}L{-}CH{=}CH_2$$

(where L is a substituted or unsubstituted alkylene oxide chain group).

Specific examples of the bifunctional ethylene oxide type curing agent are listed below for non-limiting purposes.

C-1

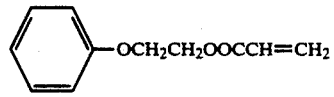

C-2

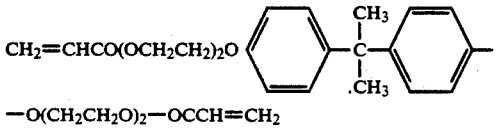

C-3 $CH_2{=}CHCO(OCH_2CH_2)_4OOCCH{=}CH_2$

C-4 $CH_2{=}CHCO(OCH_2CH_2)_9OOCCH{=}CH_2$

C-5 $CH_3CH_2C{-}(CH_2OOCCH{=}CH_2)_3$

C-6 $CH_3CH_2C{-}(CH_2OCH_2CH_2OOCCH{=}CH_2)_3$

C-7

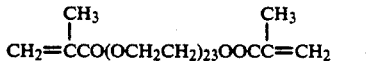

C-8

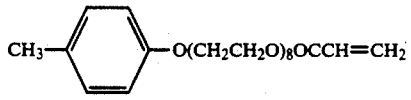

C-9

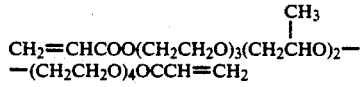

C-10

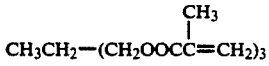

Conventionally, bifunctional ethylene oxide type curing agents have been cured by crosslinking with heat but this method is not only slow (low reaction rate) but also inefficient (insufficient crosslinking). Therefore, in the present invention, the bifunctional ethylene oxide type curing agent of the formula (C) is cured by exposure to electron beam or X-rays.

The intensities of electron beams and X-rays that are necessary to cure the bifunctional ethylene oxide type curing agent are specified below:

Electron beams: $10^{-2}$ to $10^6$ kW/m$^2$ (50 kW/m$^2$ is particularly preferred)

X-rays: $10^{-2}$ to $10^6$ kW/m$^2$ (300 kW/m$^2$ is particularly preferred)

According to another preferred embodiment of the present invention, a polyfunctional aziridine compound is used to cure the antistatic coating. Particularly preferred are bifunctional or trifunctional aziridines that have molecular weights of no more than 600. These compounds may be immediately used after they are dissolved in either water or organic solvents such as alcohol and acetone. These compounds are preferably incorporated in the antistatic coating in amounts of 1–1,000 mg/m$^2$.

If a polyfunctional aziridine compound is to be used in the antistatic coating in the photographic material of the present invention, an epoxy curing agent containing a hydroxyl group is used in hydrophilic colloidal layers on the antistatic coating. Preferred epoxy curing agents are bifunctional and other polyfunctional epoxy compounds containing at least one hydroxyl group.

Specific examples of the hydroxyl group containing epoxy curing agent that may be used in the present invention are listed below.

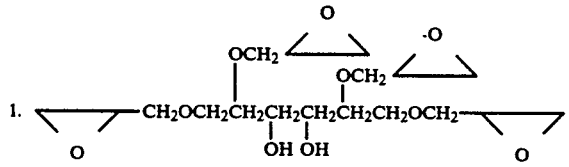

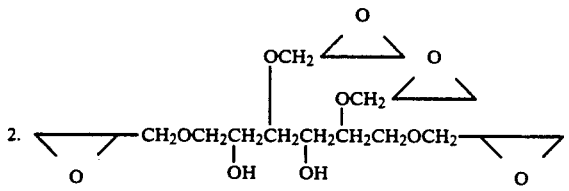

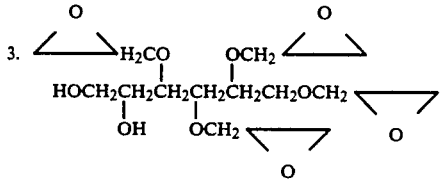

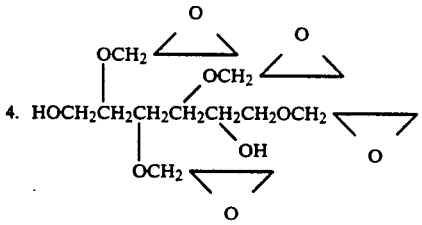

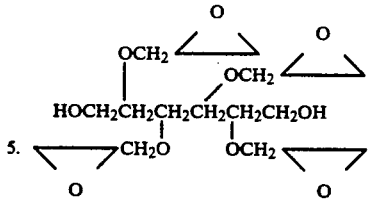

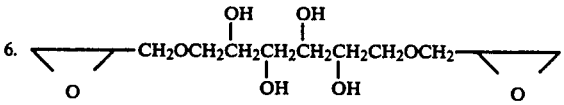

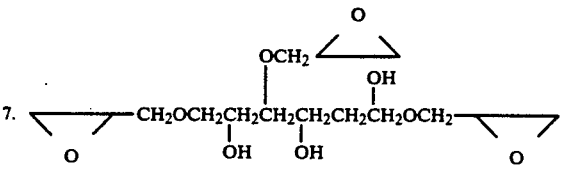

-continued

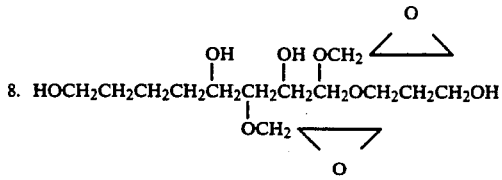

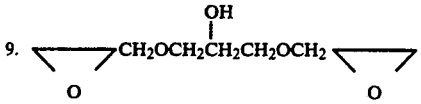

These compounds may be used immediately after they are dissolved either in water or in organic solvents such as alcohol and acetone. Alternatively, they may be added after being dispersed with the aid of surfactants such as dodecylbenzenesulfonates and nonylphenoxyalkylene oxides. These compounds are preferably incorporated in hydrophilic colloidal layers in amounts of 1–1,000 mg/m$^2$.

With a view to providing higher resistance to devitrification, polyalkylene oxide compounds are preferably used in the antistatic coating. The polyalkylene oxide compound to be used in the present invention is a compound that contains at least 3, preferably no more than 500, polyalkylene oxide chains in the molecule. Such compounds can be synthesized either by condensation reaction between polyalkylene oxides and compounds having active hydrogen atoms such as aliphatic alcohols, phenols, aliphatic acids, aliphatic mercaptans or organic amines, or by condensing polyls such as polypropylene glycol or polyoxytetramethylene polymers with aliphatic mercaptans, organic amines, ethylene oxide or propylene oxide.

Each of the polyalkylene oxide chains in the molecule of the polyalkylene oxide compound may be divided into two or more segments to form a block copolymer. In this case, the polyalkylene oxide has a total degree of polymerization in the range of 3–100.

Specific examples of the polyalkylene oxide that may be used in the present invention are enumerated below.

Illustrative compounds

| | | |
|---|---|---|
| $HO(CH_2CH_2O)nH$ | [n = 4] | [Ao-1] |
| $HO(CH_2CH_2O)nH$ | [n = 35] | [Ao-2] |
| $HO(CH_2CH_2O)nH$ | [n = 135] | [Ao-3] |
| $HO(CH_2CH_2O)nH$ | [n = 225] | [Ao-4] |
| $HO(CH_2CH_2O)nH$ | [n = 450] | [Ao-5] |
| $n\text{-}C_4H_9O(CH_2CH_2O)_lH$ | [l = 20] | [Ao-6] |
| $n\text{-}C_8H_{17}O(CH_2CH_2O)_lH$ | [l = 30] | [Ao-7] |
| $n\text{-}C_{12}H_{25}O(CH_2CH_2O)_lH$ | [l = 30] | [Ao-8] |
| 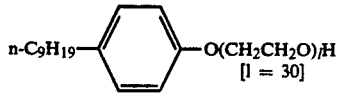 | [l = 30] | [Ao-9] |
| $n\text{-}C_{12}H_{25}S(CH_2CH_2O)_lH$ | [l = 30] | [Ao-10] |
| $C_4H_9S(CH_2CH_2O)nCOCH_2CH_2COOH$ | [n = 50] | [Ao-11] |

-continued

Illustrative compounds $HO(CH_2CH_2O)_l(CH_2)m(CH_2CH_2O)nCOCH_2CH_2COOH$ [Ao-12]
[l + n = 70, m = 5]

$HO(CH_2CH_2O)_l(CH(CH_3)CH_2O)m(CH_2CH_2O)_nH$ [Ao-13]
[l + n = 15, m = 17]

$HO(CH_2CH_2O)_l(CH(CH_3)CH_2O)m(CH_2CH_2O)nH$ [Ao-14]
[l + n = 30, m = 35]

$HO(CH_2CH_2O)_l(CH(C_2H_5)CH_2O)m(CH_2CH_2O)nH$ [Ao-15]
[l + n = 15, m = 15]

$HO(CH_2CH_2O)_l(CH(C_2H_5)CH_2O)m(CH_2CH_2O)nH$ [Ao-16]
[l + n = 30, m = 15]

$HO(CH_2CH_2O)_l(CH_2CH_2CH_2CH_2O)m(CH_2CH_2O)nH$ [Ao-17]
[l + n = 23, m = 21]

$HO(CH_2CH_2O)_l(CH_2CH_2CH_2CH_2O)m(CH_2CH_2O)nH$ [Ao-18]
[l + n = 38, m = 15]

$HO(CH_2CH_2O)_l(CH(CH_2OCH_3)CH_2O)m(CH_2CH_2O)nH$ [Ao-19]
[l + n = 15, m = 15]

$HO(CH_2CH_2O)_l(CH(CH_2OCH_3)CH_2O)m(CH_2CH_2O)nH$ [Ao-20]
[l + n = 30, m = 15]

$n\text{-}C_{12}H_{25}O(CH(CH_2OCH_3)CH_2O)_l(CH_2CH_2O)mH$ [Ao-21]
[l = 7, m = 30]

$n\text{-}C_{12}H_{25}S(CH(CH_3)CH_2O)_l(CH_2CH_2O)mH$ [Ao-22]
[l = 7, m = 30]

$HOOCCH_2CH_2C(=O)O(CH_2CH_2O)_l(CH_2CH_2O)m(CH_2CH_2O)nC(=O)CH_2CH_2COOH$ [Ao-23]
[l + n = 15, m = 15]

$HOOCCH_2CH_2C(=O)O(CH_2CH_2O)_l(CH(CH_3)CH_2O)m(CH_2CH_2O)nC(=O)CH_2CH_2COOH$ [Ao-24]
[l + n = 15, m = 20]

$C_{12}H_{25}N((CH_2CH_2O)_lH)((CH_2CH_2O)nH)$ [Ao-25]
[l + n = 30]

$C_{17}H_{33}CO(CH_2CH_2O)_{40}H$ [Ao-26]

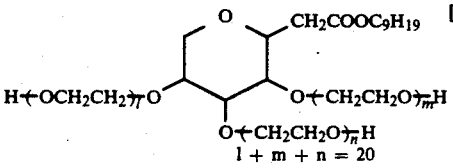
[Ao-27]
l + m + n = 20

-continued

Illustrative compounds $C_{17}H_{35}CON((CH_2CH_2O)_lH)((CH_2CH_2O)_mH)$ [Ao-28]
l + m = 12

The hydrazine compound to be used in light-sensitive emulsion layers in the photographic material of the present invention is preferably represented by the following general formula (H):

$$R_1-N(Q_1)-N(Q_2)-C(=X_1)-R_2 \quad \text{(H)}$$

where $R_1$ is a monovalent organic residue; $R_2$ is a hydrogen atom or a monovalent organic residue; $Q_1$ and $Q_2$ are each a hydrogen atom, an optionally substituted alkylsulfonyl group, or an optionally substituted arylsulfonyl group; $X_1$ is an oxygen atom or a sulfur atom.

Among the compounds represented by the general formula (H), one in which $X_1$ is an oxygen atom and $R_2$ is a hydrogen atom is particularly preferred.

Monovalent organic groups represented by $R_1$ and $R_2$ include aromatic residues, heterocyclic residues and aliphatic residues.

Illustrative aromatic residues include a phenyl group and a naphthyl group, which may have such substituents as alkyl, alkoxy, acylhydrazino, dialkylamino, alkoxycarbonyl, cyano, carboxy, nitro, alkylthio, hydroxy, sulfonyl, carbamoyl, halogen, acylamino, sulfonamido, urea and thiourea. Substituted phenyl groups include 4-methylphenyl, 4-ethylphenyl, 4-oxyethylphenyl, 4-dodecylphenyl, 4-carboxyphenyl, 4-diethylaminophenyl, 4-octylaminophenyl, 4-benzylaminophenyl, 4-acetamido-2-methylphenyl, 4-(3-ethylthioureido)phenyl, 4-[2-(2,4-di-tert-butylphenoxy)butylamido]phenyl and 4-[2-(2,4-di-tert-butylphenoxy)butylamido]phenyl.

Illustrative heterocyclic residues are 5- or 6-membered single or fused rings having at least one of oxygen, nitrogen, sulfur and selenium atoms. These rings may have substituents. Specific examples of heterocyclic residues include: pyrroline, pyridine, quinoline, indole, oxazole, benzoxazole, naphthoxazole, imidazole, benzimidazole, thiazoline, thiazole, benzothiazole, naphthothiazole selenazole, benzoselenazole and naphthoselenazole rings.

These hetero rings may be substituted by alkyl groups having 1–4 carbon atoms such as methyl and ethyl, alkoxy groups having 1–4 carbon atoms such as methoxy and ethoxy, aryl groups having 6–18 carbon atoms such as phenyl, halogen atoms such as chlorine and bromine, alkoxycarbonyl groups, cyano group, amino group, etc.

Illustrative aliphatic residues include straight-chained or branched alkyl groups, cycloalkyl groups, substituted alkyl or cycloalkyl groups, alkenyl groups and alkynyl groups. Exemplary straight-chained or branched alkyl groups are alkyl groups having 1–18, preferably 1–8, carbon atoms, such as methyl, ethyl, isobutyl and 1-octyl. Exemplary cycloalkyl groups include those having 3–10 carbon atoms, concreatly, cyclopropyl, cyclohexyl, adamantyl, etc. Substituents on alkyl and cycloalkyl groups include an alkoxy group (e.g. methoxy, ethoxy, propoxy or butoxy), an alkoxycarbonyl group, a carbamoyl group, a hydroxy group, an alkylthio group, an amido group, an acyloxy group, a cyano group, a sulfonyl group, a halogen atom (e.g. Cl, Br, F or I), an aryl group (e.g. phenyl, halogen-substituted phenyl or alkyl-substituted phenyl), etc. Specific examples of substituted cycloalkyl group include 3-methoxypropyl, ethoxycarbonylmethyl, 4-chlorocyclohexyl, benzyl, p-methylbenzyl and p-chlorobenzyl. An exemplary alkenyl group is an allyl group, and an exemplary alkynyl group is a propargyl group.

Preferred examples of the hydrazine compound that can be used in the present invention are listed below and it should be understood that they are by no means intended to limit the scope of the present invention.

H-1

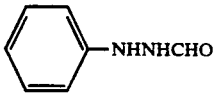

H-2

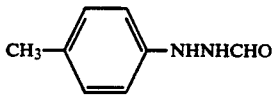

H-3

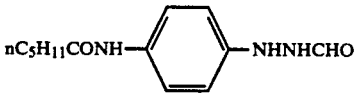

H-4

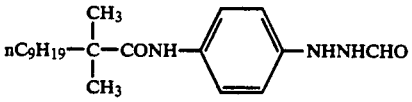

H-5

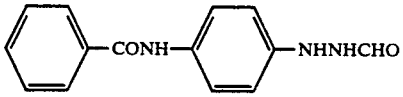

H-6

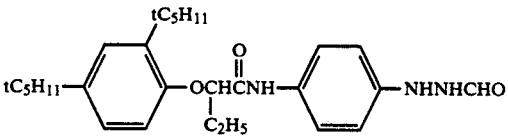

H-7

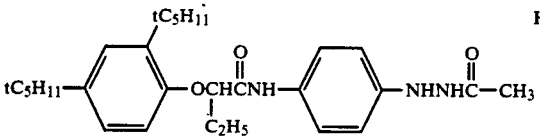

H-8

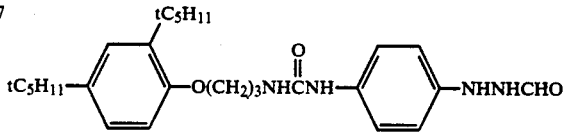

H-9

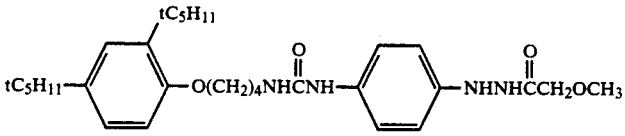

H-10

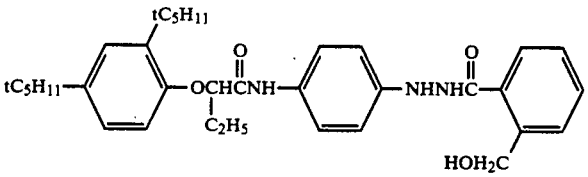

H-11

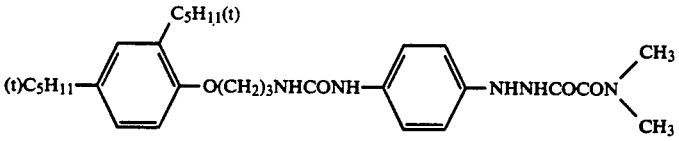

H-12

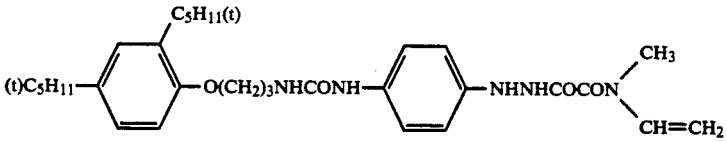

H-13

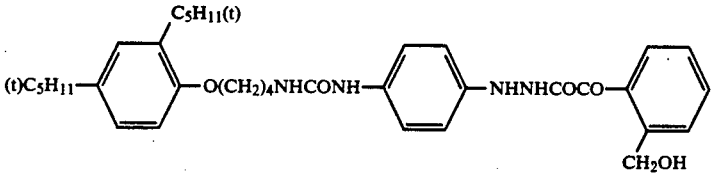

-continued
H-14
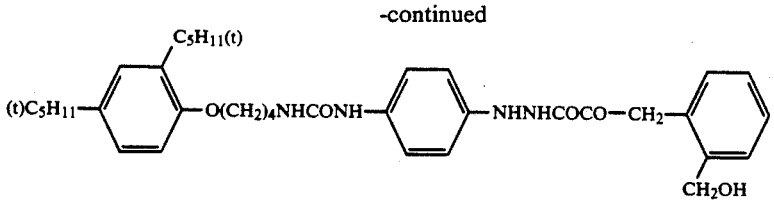
H-15
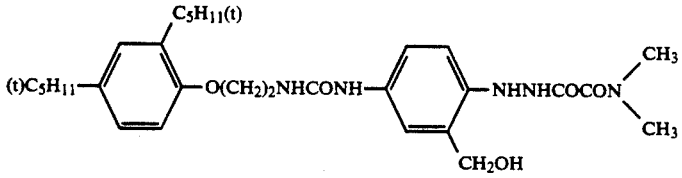
H-16
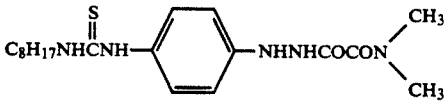
H-17
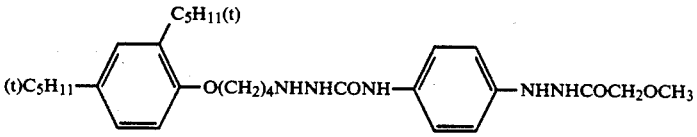
H-18
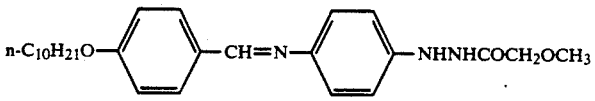
H-19
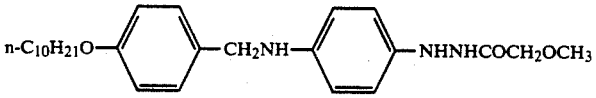
H-20
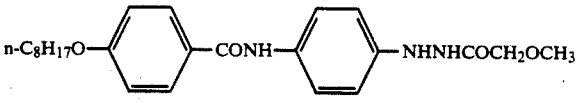
H-21
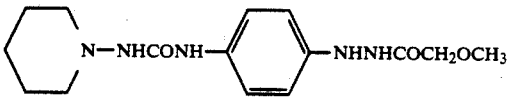
H-22
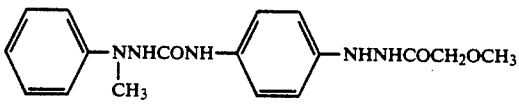
H-23
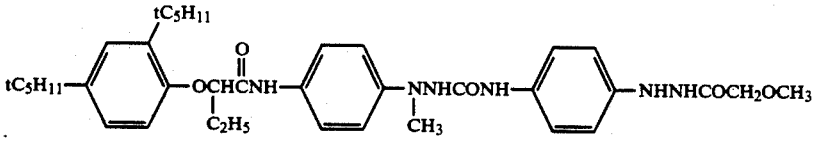
H-24
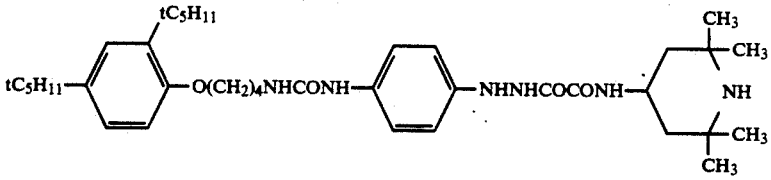
H-25
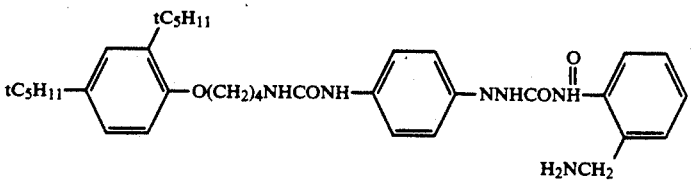

-continued
H-26
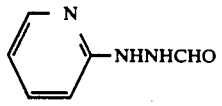
H-27
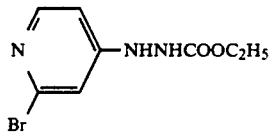
H-28
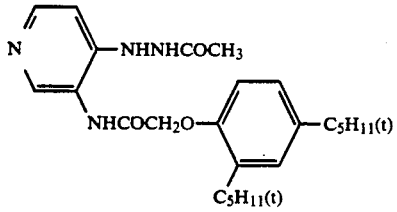
H-29
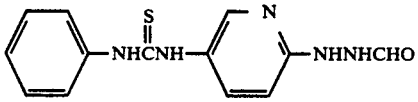
H-30
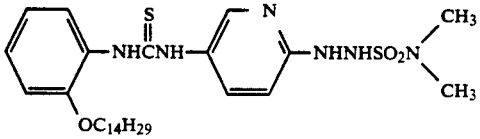
H-31
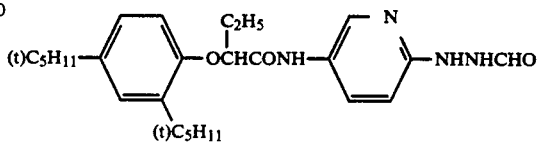
H-32
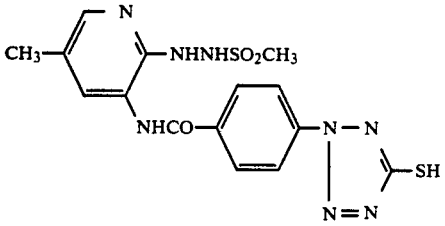
H-33
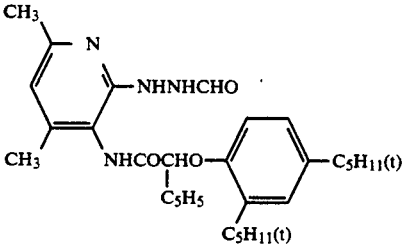
H-34
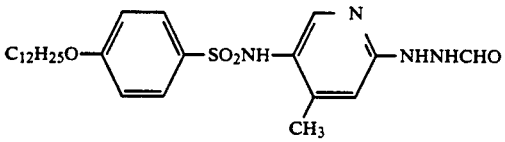
H-35
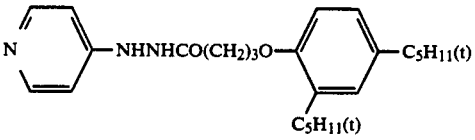
H-36
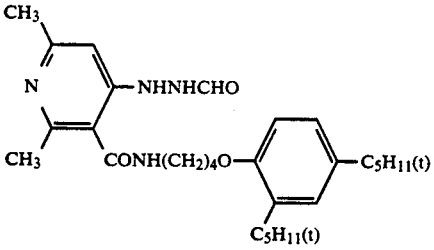
H-37
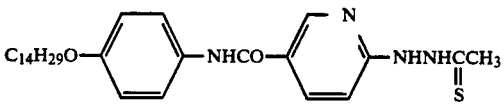
H-38
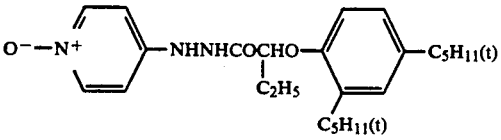
H-39
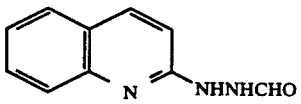
H-40
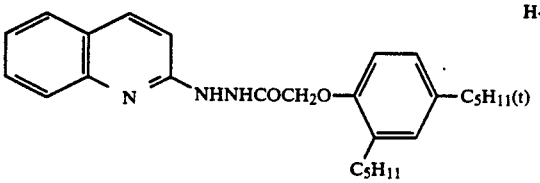
H-41
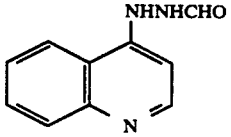

-continued

H-42

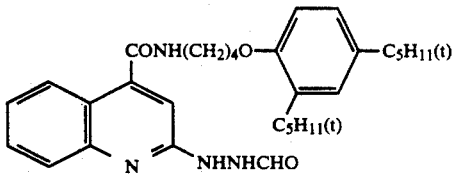

H-43

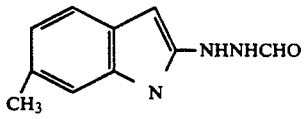

H-44

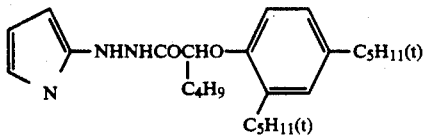

H-45

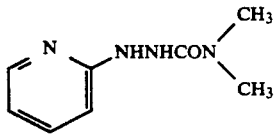

H-46

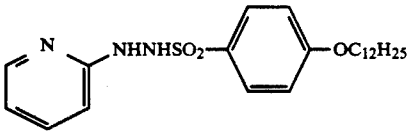

The hydrazine compound represented by the general formula (H) is incorporated in a silver halide emulsion layer. The hydrazine compound is preferably added in an amount of $10^{-5}$ to $10^{-1}$ mole per mole of Ag, more preferably from $10^{-4}$ to $10^{-2}$ mole per mole of Ag.

The tetrazolium compound to be used in light-sensitive emulsion layers in the photographic material of the present invention is described below. This tetrazolium compound may be represented by the following general formula (T):

(T)

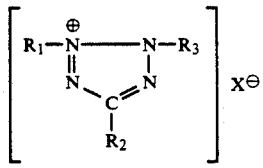

where $R_1$, $R_2$ and $R_3$ are each independently a substituted or unsubstituted phenyl group; and $X^{\ominus}$ is an anion.

The substituents $R_1$, $R_2$ and $R_3$ on the phenyl group in the triphenyl tetrazolium compound represented by the general formula (T) are preferably either a hydrogen atom or those which have a negative or positive value of Hamett's sigma (δ P) which represents an electron withdrawing ability. Substituents having a negative value of δ p are particularly preferred.

Hamett's sigma value in relation to phenyl substitution is found in many documents including the article of C. Hansch et al. in Journal of Medical Chemistry, 20, 304, 1977. Illustrative groups having particularly preferred negative sigma values include: methyl (δ P=−0.17; the figures in parentheses that appear in the following description refer to δ P values); ethyl (−0.15); cyclopropyl (−0.21); n-propyl (−0.13); isopropyl (−0.15); cyclobutyl (−0.15); n-butyl (−0.16); iso-o-butyl (−0.20); n-pentyl (−0.15); cyclohexyl (−0.22); amino (−0.66); acetylamino (−0.15); hydroxyl (−0.37); methoxy (−0.27); ethoxy (−0.24); propoxy (−0.25); butoxy (−0.32); and pentoxy (−0.34). All of these groups are useful as substituents on the compound (T) to be used in the present invention.

Specific examples of the compound of the general formula (T) to be used in the present invention are listed below but it should be understood that they are by no means intended to limit the scope of the present invention.

Illustrative compounds

T-1

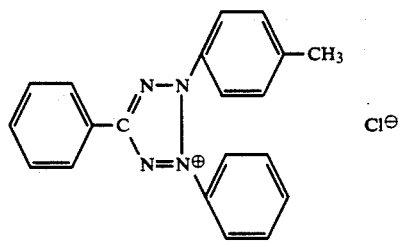

T-2

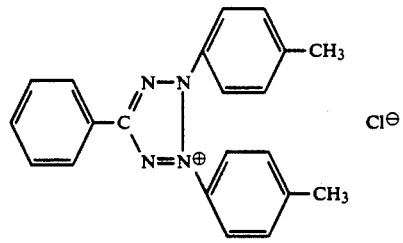

T-3

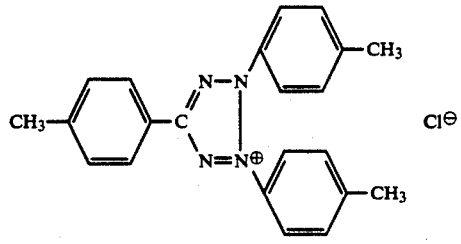

T-4

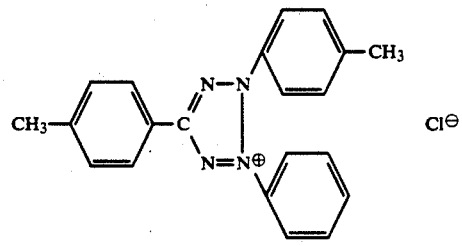

-continued
Illustrative compounds
T-5
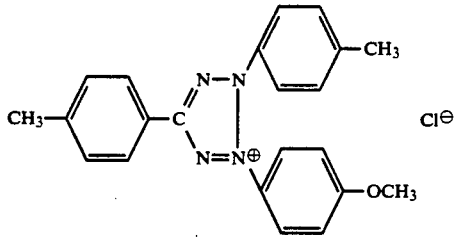
T-6
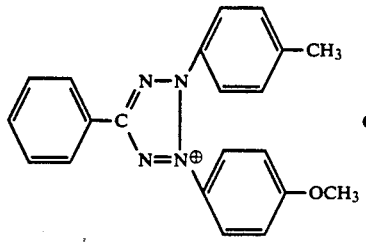
T-7
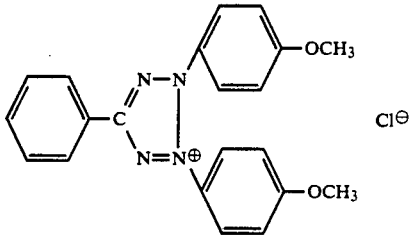
T-8
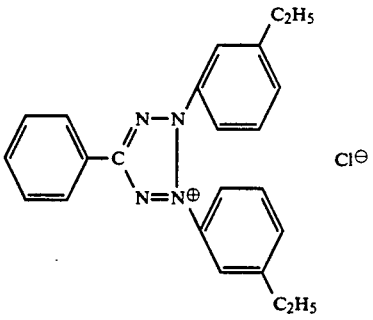
T-9
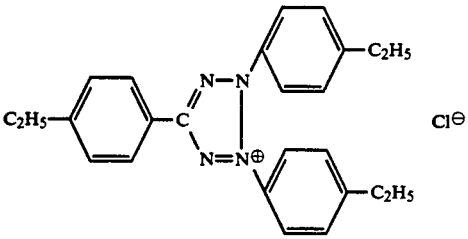
T-10
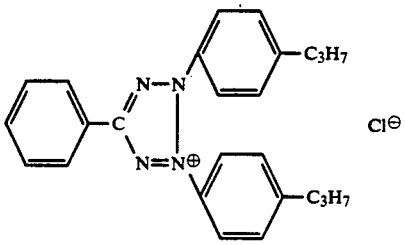
-continued
Illustrative compounds
T-11
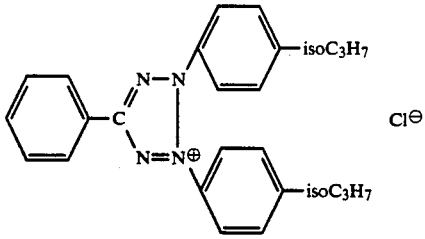
T-12
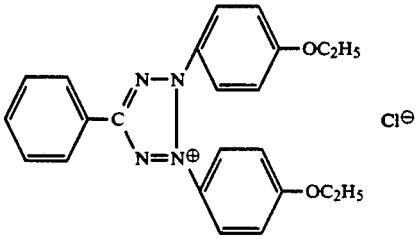
T-13
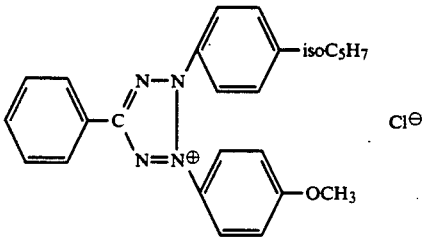
T-14
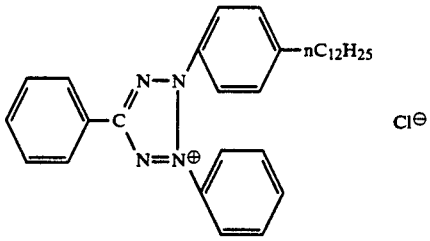
T-15
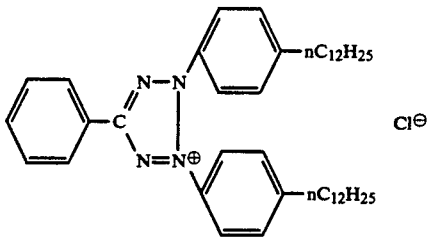
T-16
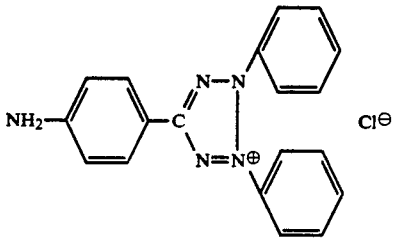

-continued

Illustrative compounds

T-17

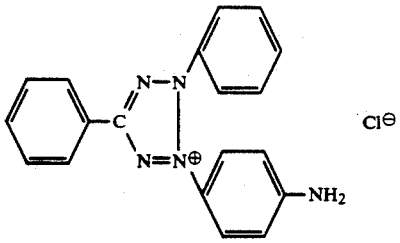

T-18

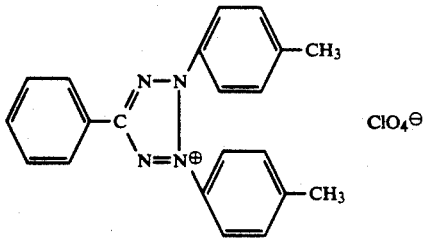

The tetrazolium compounds to beused in the present invention can be easily synthesized by known methods, for example, the one described in Chemical Reviews, 55, 335–483.

The tetrazolium compound is used in light-sensitive emulsion layers in the silver halide photographic material of the present invention. It is preferably incorporated in an amount of from about 1 mg to 10 g, more preferably from about 10 mg to about 2 g, per mole of silver halide.

Preferred characteristics can beobtained by using the tetrazolium compounds individually but it should be mentioned that such preferred characteristics will not deteriorate even if a plurality of the tetrazolium compounds are combined in various proportions.

The silver halide to be used in the silver halide photographic material of the present invention may have any composition such as silver chloride, silver chlorobromide, silver chloroiodobromide, etc., and it preferably contains at least 50 mol % silver chloride. Silver halide grains preferably have average grain sizes in the range of 0.025–0.5 μm, with the range of 0.05–0.30 μm being more preferred.

The monodispersity of the silver halide grains to be used in the present invention is defined by the following formula (1) and the grains are prepared in such a way that the value of monodispersity is preferably within the range of 5–60, more preferably in the range of 8–30. The grain size of the silver halide grains to be used in the present invention may conveniently be expressed in terms of the length of a side of a cubic grain and their monodispersity is determined by first dividing the standard deviation of the grain size by the mean size and then multiplying the quotient by 100:

$$\sqrt{\frac{\Sigma(r-\bar{r})^2 ni}{\Sigma ni}} \div \bar{r} \times 100 \quad (1)$$

The silver halide for use in the present invention is preferably of a type having a multi-layered structure composed of at least two layers. For example, it may be of a core/shell type silver chlorobromide grain with the core being made of silver chloride and the shell silver bromide, or conversely, the core being made of silver bromide and the shell silver chloride. Iodine may be contained in a desired layer in an amount of no more than 5 mol %.

Two or more kinds of grains may be used in admixture. For example, primary emulsion grains which are cubic, octahedral or tabular silver chloroiodobromide grains containing no more than 10 mol % AgCl and no more than 5 mol % I may be mixed with secondary grains which are cubic, octahedral or tabular silver chloroiodobromide grains containing no more than 5 mol % I and at least 50 mol % AgCl. In the case of using two kinds of grains in admixture, the primary and secondary grains may or may not be chemically sensitized. If desired, the secondary grains may be subjected to less chemical sensitization (sulfur or gold sensitization) than the primary grains so that the former will have a lower sensitivity; alternatively, their sensitivity may be reduced by controlling the grain size or the amount of rhodium and other noble metals to be doped in the grains. The interior of the secondary grains may be fogged with gold or, alternatively, they may be fogged with the halide composition being made different by the core/shell process. The smaller the size of the primary and secondary grains, the better. These grains may have a desired size in the range of 0.025–1.0 μm.

In preparing the silver halide emulsion to be used in the present invention, a rhodium salt may be added for sensitivity or gradient control. It is generally preferred to add rhodium salts during the formation of grains but they may be added during chemical ripening or during the preparation of an emulsion coating solution.

Rhodium salts to be incorporated in the silver halide emulsion for use in the present invention may be simple salts or complex salts. Typical examples of useful rhodium salts include rhodium chloride, rhodium trichloride and rhodium ammonium chloride.

The amount of rhodium salts to be added may be freely changed in accordance with the sensitivity and gradient required but a particularly useful range is from $10^{-9}$ to $10^{-4}$ moles per mole of silver.

Rhodium salts may be used in combination with other inorganic compounds such as iridium salts, platinum salts, thallium salts, cobalt salts and gold salts. Iridium salts are often added for the purpose of improvement in highintensity characteristics and they are preferably used in amounts ranging from $10^{-9}$ to $10^{-4}$ moles per mole of silver.

Silver halides to be used in the present invention can be sensitized with various chemical sensitizers. Exemplary sensitizers include activated gelatin, sulfur sensitizers (e.g. sodium thiosulfate, allyl thiocarbamide, thiourea and allyl isothiocyanate), selenium sensitizers (e.g. N,N-dimethylselenourea and selenourea), reduction sensitizers (e.g. triethylenetetramine and stannous chloride), as well as various noble metal sensitizers typified by potassium chloroaurite, potassium aurithiocyanate, potassium chloroaurate, 2-aurosulfobenzothiazole methyl chloride, ammonium chloropalladate, potassium chloroplatinate and sodium chloropalladite. These sensitizers may be used either on their own or as admixtures. If gold sensitizers are to be used, ammonium thiocyanate may also be used as an auxiliary agent.

In the present invention, silver halide emulsions may be used in combination with desensitizing dyes and/or uv absorbers of the types described in prior patents such as U.S. Pat. Nos. 3,567,456, 3,615,639, 3,579,345, 3,615,608, 3,598,596, 3,598,955, 3,592,653, 3,582,343, Japanese Patent Publication Nos. 26751/1965, 27332/1965, 13167/1968, 8833/1970 and 8746/1972.

The silver halide emulsions to be used in the present invention may be stabilized with various compounds such as those described in prior patents including U.S. Pat. Nos. 2,444,607, 2,716,062, 3,512,982, West German Patent Publication Nos. 1,189,380, 2,058,626, 2,118,411, Japanese Patent Publication No. 4133/1968, U.S. Pat. No. 3,342,596, Japanese Patent Publication No. 4417/1972, West German Patent Publication No. 2,149,789, Japanese Patent Publication Nos. 2825/1964 and 13566/1974. Preferred examples of the compounds that can be used for stabilizing purposes include: 5,6-trimethylene-7-hydroxy-S-triazolo (1,5-a)pyrimidine, 5,6-tetramethylene-7-hydroxy-S-triazolo (1,5-a)pyrimidine, 5-methyl-7-hydroxy-S-triazolo(1,5-a)-pyrimidine, 5-methyl-7-hydroxy-S-triazolo(1,5-a)pyrimidine, 7-hydroxy-S-triazolo(1,5-a)pyrimidine, 5-methyl-6-bromo-7-hydroxy-S-triazolo(1,5-a)pyrimidine, gallic acid esters (e.g. isoamyl gallate, dodecyl gallate, propyl gallate and sodium gallate), mercaptans (e.g. 1-phenyl-5-mercaptotetrazole, 2-mercaptobenzothiazole), benzotriazoles (e.g. 5-bromobenzotriazole, 5-methyl-benzotriazole), and benzimidazoles (e.g. 6-nitrobenzimidazole).

The silver halide photographic material of the present invention and/or developers preferably have amino compounds incorporated therein. Amino compounds that are preferably used in the present invention include primary, secondary, tertiary and quaternary amines. Preferred amino compounds are alkanolamines. Specific examples of preferred amino compounds are listed below for non-limiting purposes:

diethylaminoethanol;
diethylaminobutanol;
diethyaminopropane-1,2-diol;
dimethylaminopropane-1,2-diol;
diethanolamine;
diethylamino-1-propanol;
triethanolamine;
dipropylaminopropane-1,2-diol;
dioctylamino-1-ethanol;
dioctylaminopropane-1,2-diol;
dodecylaminopropane-1,2-diol;
dodecylamino-1-propanol;
dodecylamino-1-ethanol;
aminopropane-1,2-diol;
diethylamino-2-propanol;
dipropanolamine;
glycine;
triethylamine; and
triethylenediamine;

These amino compounds may be incorporated in at least one of the layers coated on the side of a silver halide photographic material where light-sensitive layers are formed (i.e., hydrophilic colloidal layers such as silver halide emulsion layers, protective layers and subbing layers) and/or the developing solution. In a preferred embodiment, the amino compounds are contained in the developing solution. The amount of amino compounds to be incorporated depends on the site where they are incorporated and the type of the specific amino compound used but their amount should not be smaller than the level necessary to enhance the contrast.

In order to provide enhanced developability, developing agents such as phenidone and hydroquinone, or restrainers such as benzotriazole may be incorporated in emulsion layers. Alternatively, developing agents and restrainers may be incorporated in backing layers in order to enhance the ability of various processing solutions.

Gelatin is used with particular advantage as a hydrophilic colloid in the present invention. Other hydrophilic colloids that can be used include: colloidal albumin, agar, gum arabic, alginic acid, hydrolyzed cellulose acetate, acrylamide, imidized polyamide, polyvinyl alcohol, hydrolyzed polyvinyl acetate, and gelatin derivatives such as the phenylcarbamyl gelatin, acylated gelatin and phthalated gelatin described in U.S. Pat. Nos. 2,614,928 and 2,525,753, and graft copolymers of gelatin with polymerizable monomers having an ethylene group such as acrylic acid, styrene, acrylate esters, methacrylic acid and methacrylate esters, which graft copolymers are described in U.S. Pat. Nos. 2,548,520 and 2,831,767. These hydrophilic colloids may also be incorporated in those layers which do not contain silver halides, such as anti-halation layers, protective layers and intermediate layers.

Typical examples of the support that can be used in the present invention include polyester (e.g. polyethylene terephthalate) films, polyamide films, polypropylene films, polycarbonate films, polystyrene films, cellulose acetate films, and cellulose nitrate films. A suitable support should be selected in accordance with the specific object of use of the silver halide photographic material of the present invention.

Illustrative developing agents that can be used to develop the silver halide photographic material of the present invention include those of HO—(CH=CH-)$_n$—OH type which are typified by hydroquinone, its derivatives such as chlorohydroquinone, bromohydroquinone, methylhydroquinone, 2,3-dibromohydroquinone, 2,5-diethylhydroquinone, catechol, its derivatives such as 4-chlorocatechol, 4-phenylcatechol, 3-methoxycatechol, pyrogallol, its derivatives such as 4-acetylpyrogallol, ascorbic acid and its derivatives such as sodium ascorbate.

Developing agents of HO—(CH=CH)$_n$—$NH_2$ type may be represented by ortho- and para-aminophenols such as 4-aminophenol, 2-amino-6-phenylphenol, 2-amino-4-chloro-6-phenylphenol and N-methyl-p-aminophenol.

Exemplary developing agents of $H_2N$—(CH=CH-)$_n$—$NH_2$ type include 4-amino-2-methyl-N,N-diethylaniline, 2,4-diamino-N,N-diethylaniline, N-(4-amino-3-methylphenyl)morpholine and p-phenylenediamine.

Exemplary heterocyclic developing agents include 3-pyrazolidones such as 1-phenyl-3-pyrazolidone, 1-phenyl- 4,4-dimethyl-3-pyrazolidone and 1-phenyl-4-methyl-4-hydroxymethyl-3-pyrazolidone, 1-phenyl-4-amino-5-pyrazolone, and 5-aminouracil.

The developing agents that can be used effectively in the present invention are described in T. H. James, ed., The Theory of the Photographic Process, 4th ed., pp. 291-334 and Journal of the American Chemical Society, 73, 3,100 (1951). These developing agents may be used either singly or as admixtures and they are preferably used as admixtures. Developers that are used to develop the photographic material of the present invention may contain preservatives selected from among sulfites such as sodium sulfite and potassium sulfite and the inclusion of such preservatives will not be delterious to the objects of the present invention. Hydroxylamines and hydrazide compounds may also be used as preservatives and, in this case, they are preferably used in amounts of 5-500 g, more preferably from 20 to 200 g, per liter of the developer.

Glycols may be contained as organic solvents in the developer and exemplary glycols include ethylene glycol, diethylene glycol, propylene glycol, triethylene glycol, 1,4-butanediol and 1,5-pentadiol, with diethylene glycol being preferably used. These glycols are preferably used in amounts of 5-500 g, more preferably from 20 to 200 g, per liter of the developer. These organic solvents may be used either singly or as admixtures.

The silver halide photographic material of the present invention has very good keeping quality if it is processed with a developer that contains one or more of the development restrainers described above.

The developer of the composition described above preferably has a pH of 9-13, with the range of 10-12 being more preferred from the viewpoints of preservability and photographic characteristics. As regards cations in the developer, the proportion of potassium ions is preferably higher than that of sodium ions, in order to enhance the activity of the developer.

The silver halide photographic material of the present invention can be processed under various conditions. The processing temperature, for example, the development temperature is preferably not higher than 50° C, more preferably within the range of 25°-40° C. The development time is typically set to be no longer than 2 min, and particularly good results are often achieved by completing the development within 10-50 sec. Other processing steps such as washing, stopping, stabilizing and fixing may also be performed under usual conditions. If desired, prehardening, neutralizing and any other necessary steps may be included. Of course, these additional steps may be omitted depending on the case. Development may be carried out either manually (e.g. tray development or rack development) or mechanically (e.g. roller development or hanger development).

The following examples are provided for the purpose of further illustrating the present invention but are in no way to be taken as limiting.

EXAMPLE 1

Subbed polyethylene terephthalate films were subjected to corona discharge treatment at an energy of 8 W/m$^2$ per min. Thereafter, antistatic coating solutions having the composition described below were applied with a roll fit coating pan and an air knife at a rate of 30 m/min to provide deposits also shown below.

Water-soluble conductive polymer (A) (see Table 1): 0.6 g/m$^2$

Hydrophobic polymer particles (B) (see Table 1): 0.4 g/m$^2$

Curing agent (C): 0.1 g/m$^2$

The applied antistatic coatings were dried at 90° C. for 2 min and subsequently heat-treated at 140° C. for 90 sec. Thereafter the coatings were cured by exposure to electron beams or X-rays under the conditions described in Table 1.

Gelatin was applied onto these antistatic coatings to provide a deposit of 2.0 g/m$^2$. The so prepared samples were subjected to a crack test. Formaldehyde and 2,4-dichloro-6-hydroxy-S-triazine sodium were used as hardeners of gelatin. The results of the crack test are shown in Table 1.

CRACK TEST

A test piece was placed in a container that had been dried with silica gel to a relative humidity of approximately 0%. Subsequently, the container was sealed and the test piece was stored at 40° C. for 3 days. After aging, the test piece was recovered from the container and the degree of cracking that occurred in the test piece was visually evaluated in accordance with the following criteria: , no crack; Δ, some cracks occurred but the sample was acceptable for practical purposes; X. so many cracks occurred that the sample was unacceptable for practical purposes.

TABLE 1

| No. | water-soluble conductive polymer (A) | hydrophobic polymer particles (B) | hardening agent (C) | radiation | intensity (KW/m$^2$) | cracking | remarks |
|---|---|---|---|---|---|---|---|
| 1 | 3 | 3 | 3 | EB* | 50 | ○ | Invention |
| 2 | 4 | 7 | 6 | EB | 50 | ○ | Invention |
| 3 | 6 | 8 | 2 | EB | 50 | ○ | Invention |
| 4 | 7 | 2 | 5 | EB | 50 | ○ | Invention |
| 5 | 9 | 3 | 8 | EB | 50 | Δ | Invention |
| 6 | 10 | 8 | 1 | EB | 50 | ○ | Invention |
| 7 | 11 | 5 | 2 | X-rays | 300 | ○ | Invention |
| 8 | 12 | 12 | 9 | X-rays | 300 | ○ | Invention |
| 9 | 17 | 9 | 4 | X-rays | 300 | ○ | Invention |
| 10 | 19 | 6 | 6 | X-rays | 300 | ○ | Invention |
| 11 | 19 | 6 | 6 | — | — | X | comparison |
| 12 | 19 | 6 | a | — | — | X | comparison |

*electron beams a: compound described in Unexamined Published Japanese Patent Application No. 84658/1980:

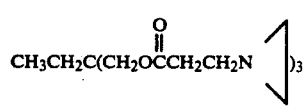

Table 1 shows that the samples prepared in accordance with the present invention had satisfactory resistance to cracking.

EXAMPLE 2

Preparation of Emulsions

Silver chlorobromide (5 mol % AgBr) grains that contained a rhodium salt in an amount of $10^{-5}$ mole per mole of silver and which had an average grain size of 0.11 μm with a monodispersity of 15 were prepared by a controlled double-jet method in an acidic atmosphere (pH 3.0). The grains were grown in a system containing 30 mg of benzyladenine in 1,000 ml of a 1% aqueous gelatin solution. After mixing silver and the halide, 6-methyl-4-hydroxy-1,3,3a,7-tetrazaindene was added in an amount of 600 mg per mole of silver halide, and mixture was subsequently washed and desalted.

In the next step, 6-methyl-4-hydroxy-1,3,3a, 7-tetrazaindene was added in an amount of 60 mg per mole of silver halide and thereafter sodium thiosulfate was added in an amount of 15 mg per mole of silver halide, followed by sulfur sensitization at 60° C. After the sulfur sensitization, 6-methyl-4-hydroxy-1,3,3a, 7-tetrazaindene was added as a stablizer in an amount of 600 mg per mole of silver halide.

To the thus prepared emulsions, the additives shown below were added to provide the deposits also shown below, and the resulting coating solutions were applied onto polyethylene terephthalate supports in a thickness of 100 μm that had been subbed with a latex polymer in accordance with Example 1 described in Unexamined Published Japanese Patent Application No. 19941/1984.

| | |
|---|---|
| Latex polymer (terpolymer of styrene, butyl acrylate and acrylic acid) | 1.0 g/m$^2$ |
| Tetraphenylphosphonium chloride | 30 mg/m$^2$ |
| Saponin | 200 mg/m$^2$ |
| polyethylene glycol | 100 mg/m$^2$ |
| Hydroquinone | 200 mg/m$^2$ |
| Styrene-maleic acid copolymer | 20 mg/m$^2$ |
| Hydrazine compound (see Table 2) | 50 mg/m$^2$ |
| 5-Methylbenzotriazole | 30 mg/m$^2$ |
| Desensitizing dye (M) | 20 mg/m$^2$ |
| Alkali-processed gelatin (isoelectric point = 4.9) | 1.5 g/m$^2$ |
| Bis(vinylsulfonylmethyl)ether | 15 mg/m$^2$ |
| Silver deposit | 2.8 g/m$^2$ |

Desensitizing dye (M):

-continued

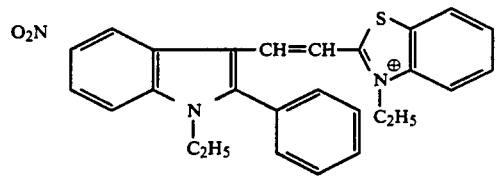

Protective Film For Emulsion Layer

Coating solution for the protective film for the emulsion layer was prepared to provide the deposits described below and was applied together with the emulsion to be superposed on the latter.

| | |
|---|---|
| Fluorinated dioctyl sulfosuccinate ester | 200 mg/m$^2$ |
| Sodium dodecyldenzenesulfonate | 100 mg/m$^2$ |
| Matting agent (polymethyl methacrylate; average particle size, 3.5 μm) | 100 mg/m$^2$ |
| Lithium nitrate salt | 30 mg/m$^2$ |
| Propyl gallate ester | 300 mg/m$^2$ |
| Sodium 2-mercaptobenzimidazole-5-sulfonate | 30 mg/m$^2$ |
| Alkali-processed gelatin (isoelectric point, 4.9) | 1.3 g/m$^2$ |
| Colloidal silica | 30 mg/m$^2$ |
| Styrene-maleic acid copolymer | 100 mg/m$^2$ |
| Bis(vinylsulfonylmethyl)ether | 15 mg/m$^2$ |

The other side of the support which was opposite the emulsion layer was subjected to corona discharge treatment at a power of 30 W/m$^2$ per min and coated with a poly(styrene-butyl acrylateglycidyl methacrylate) latex polymer in the presence of a hardner (hexamethylene aziridine), and further overlaid with an antiststic coating as in Example 1. Subsequently, a coating solution for backing layer was prepared to the formula indicated below in such a way the additives contained would have the deposits also shown below. The so prepared solution was coated to form a backing layer.

BACKING LAYER

| | |
|---|---|
| Latex polymer (butylacrylate/styrene copolymer) | 0.5 g/m$^2$ |
| Styrene-maleic acid copolymer | 100 mg/m$^2$ |
| Citric acid (adjusted to pH 5.4 after coating) | 40 mg/m$^2$ |
| Saponin | 200 mg/m$^2$ |
| Lithium nitrate salt | 30 mg/m$^2$ |
| Backing dyes: | |
| (a) 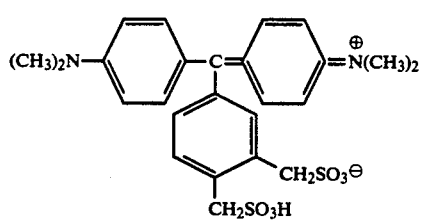 | 40 mg/m$^2$ |
| (b) 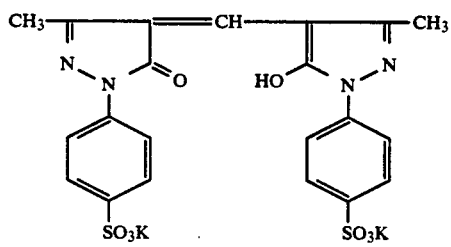 | 30 mg/m$^2$ |

-continued

| | |
|---|---|
| (c) 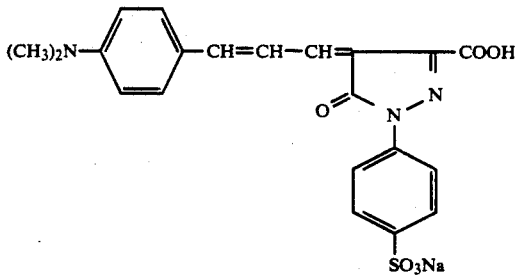 | 30 mg/m$^2$ |
| Alkali-processed gelatin | 2.0 g/m$^2$ |
| Bis(vinylsulfonylmethyl)ether | 15 mg/m$^2$ |

Protective Film For Backing Layer

A coating solution for the protective film for backing layer was prepared to the formula shown below in such a way that the additives used would provide the deposits also shown below. The so prepared coating solution was applied together with the backing layer in superposion on the latter.

| | |
|---|---|
| Dioctyl sulfosuccinate ester | 200 mg/m$^2$ |
| Matting agent (polymethyl methacrylate: average particle size, 4,0 μm) | 50 mg/m$^2$ |
| Alkali-processed gelatin (isoelectric point = 4.9) | 1.0 g/m$^2$ |
| Fluorinated sodium dodecylbenzenesulfonate | 50 mg/m$^2$ |
| Bis(vinylsulfonylmethyl)ether | 20 mg/m$^2$ |

The coating solutions described above were applied after preliminary pH adjustment to 5.4.

Each of the samples thus prepared was divided into two parts; one part was stored at 23° C.×55% r.h. for 3 days, and the other part was humidified at 23° C.×55% for 3 h, packed in superposion on one another in a moisture-proof bag and stored under accelerated aging conditions (at 55° C. for 3 days) to prepare aged specimens. Both types of specimens were exposed through an optical step wedge and processed with a developer and a fixing solution that had the formulations shown below. Thereafter, the sensitivity and specific surface resistance of each specimen were measured. The sensitivity was determined as the amount of exposure necessary to provide an optical density of 1.0 and expressed in terms of relative values. The results are shown in Table 2.

PROCESSING SCHEME

| Step | Temperature (°C.) | Time (sec) |
|---|---|---|
| Development | 34 | 15 |
| Fixing | 32 | 10 |

-continued

| Step | Temperature (°C.) | Time (sec) |
|---|---|---|
| Washing | R.T. | 10 |

DEVELOPER

| | |
|---|---|
| Hydroquinone | 25 g |
| 1-Phenyl-4,4-dimethyl-3-pyrazolidone | 0.4 g |
| Sodium bromide | 3 g |
| 5-Methyl benzotriazole | 0.3 g |
| 5-Nitroindazole | 0.05 g |
| Diethylaminopropane-1,2-diol | 10 g |
| Potassium sulfite | 90 g |
| Sodium 5-sulfosalicylate | 75 g |
| Ethylenediaminetetraacetic acid sodium salt | 2 g |
| Water | to make 1,000 ml |
| pH adjusted to 11.5 with sodium hydroxide | |

FIXING SOLUTION

Formula A

| | |
|---|---|
| Ammonium thiosulfate (72.5 wt % aq. sol.) | 240 ml |
| Sodium sulfite | 17 g |
| Sodium acetate ($3H_2O$) | 6.5 g |
| Boric acid | 6 g |
| Sodium citrate ($2H_2O$) | 2 g |
| Acetic acid (90 wt % aq. sol.) | 13.6 ml |

Formula B

| | |
|---|---|
| Pure water (ion-exchanged water) | 17 ml |
| Sulfuric acid (50 wt % aq. sol.) | 4.7 g |
| Aluminum sulfate (aq. sol. with 8.1 wt % $Al_2O_3$) | 26.5 g |

Before use, formulas A and B were successively dissolved in 500 ml of water and worked up to a total volume of 1,000 ml. The resulting fixing solution had a pH of ca. 4.3.

TABLE 2

| No. | Water-soluble conductive polymer (A) | Hydrophobic polymer (B) | Curing agent (C) | Radiation | Intensity (KW/m$^2$) | Hydrazine compound (H) | Specific surface resistance Ω I* | Specific surface resistance Ω II** | Relative sensitivity I* | Relative sensitivity II** | Remarks |
|---|---|---|---|---|---|---|---|---|---|---|---|
| 2-1 | 3 | 3 | 3 | EB | 50 | 25 | $1.6 \times 10^{10}$ | $3.0 \times 10^{10}$ | 100 | 90 | Invention |
| 2-2 | 6 | 8 | 2 | EB | 50 | 24 | $2.2 \times 10^{10}$ | $4.4 \times 10^{10}$ | 100 | 85 | Invention |
| 2-3 | 9 | 3 | 8 | EB | 50 | 1 | $1.8 \times 10^{10}$ | $3.2 \times 10^{10}$ | 110 | 105 | Invention |
| 2-4 | 11 | 5 | 2 | X-rays | 300 | 23 | $1.9 \times 10^{10}$ | $4.1 \times 10^{10}$ | 120 | 105 | Invention |
| 2-5 | 17 | 9 | 4 | X-rays | 300 | 24 | $2.2 \times 10^{10}$ | $4.2 \times 10^{10}$ | 100 | 90 | Invention |

TABLE 2-continued

| No. | Water-soluble conductive polymer (A) | Hydrophobic polymer (B) | Curing agent (C) | Radiation | Intensity ($KW/m^2$) | Hydrazine compound (H) | Specific surface resistance Ω I* | Specific surface resistance Ω II** | Relative sensitivity I* | Relative sensitivity II** | Remarks |
|---|---|---|---|---|---|---|---|---|---|---|---|
| 2-6 | 17 | 9 | a | — | — | 24 | $2.2 \times 10^{10}$ | $2.0 \times 10^{13}$ | 100 | 30 | Comparison |

*I: Measured after storage at 23° C. × 55% r.h. for 3 days.

**II: Measured after storage in moisture-proof bag at 55° C. for 3 days following humidification at 23° C. × 55% r.h. for 3 h.

As is clear from the data in Table, the samples prepared in accordance with the present invention experienced less desensitization during storage and the antistatic coating used did not deteriorate so much as the comparative sample upon processing.

EXAMPLE 3

Silver chlorobromide (2 mol % AgBr) grains that contained a rhodium salt in an amount of $10^{-5}$ mole per mole of silver and which had an average grain size of 0.20 μm at a monodispersity of 20 were prepared as in Example 2. These grains were treated, washed with water, desalted and subjected to sulfur sensitization as in Example 2.

Additives prepared to provide the deposits described below were added to the emulsion thus prepared, and the resulting coating solution was applied to subbed polyethylene terephthalate films of the same type as used in Example 1.

| | |
|---|---|
| Latex polymer (terpolymer of styrene, butyl acrylate and acrylic acid) | 1.0 $g/m^2$ |
| Phenol | 1 $mg/m^2$ |
| Saponin | 200 $mg/m^2$ |
| Sodium dodecylbenzenesulfonate | 50 $mg/m^2$ |
| Tetrazolium compound (see Table 3) | 50 $mg/m^2$ |
| Compound (N) | 40 $mg/m^2$ |
| Compound (O) | 50 $mg/m^2$ |
| Styrene-maleic acid copolymer | 20 $mg/m^2$ |
| Alkali-processed gelatin (isoelectric point = 4.9) | 2.0 $g/m^2$ |
| Silver deposit | 3.5 $g/m^2$ |
| Formaldehyde | 10 $mg/m^2$ |

Compound (N):

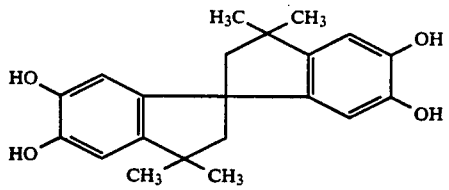

Compound (O):

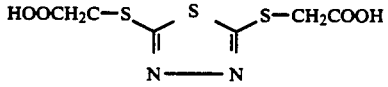

The coating solution described above was applied after preliminary pH adjustment to 6.5 with sodium hydroxide. A coating solution for protective film for the emulsion layer was prepared using the additives described below in such a way that they would provide the deposits also shown below, and the thus prepared coating solution was applied together with the emulsion coating solution in superposition on the latter.

| | |
|---|---|
| Fluorinated dioctyl sulfosuccinate ester | 100 $mg/m^2$ |
| Dioctyl sulfosuccinate ester | 100 $mg/m^2$ |
| Matting agent (amorphous silica) | 50 $mg/m^2$ |
| Compound (O) | 30 $mg/m^2$ |
| 5-Methylbenzotriazole | 20 $mg/m^2$ |
| Compound (P) | 500 $mg/m^2$ |
| Propyl gallate ester | 300 $mg/m^2$ |
| Styrene-maleic acid copolymer | 100 $mg/m^2$ |
| Alkali-processed gelatin (isoelectric point = 4.9) | 1.0 $g/m^2$ |
| Formaldehyde | 10 $mg/m^2$ |

This coating solution was applied after preliminary pH adjustment to 5.4 with citric acid.

Compound (P):

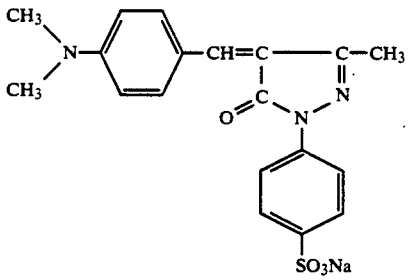

In the next step, an antistatic coating and a backing layer were provided as in Example 2 on the other side of the support which was opposite the emulsion layer, except that formaldehyde was used as a hardener in the backing layer.

The samples thus prepared were processed and their performance evaluated as in Example 2, except that the following two recipes were used as developer. The results are shown in Table 3.

| | |
|---|---|
| **Formula A** | |
| Pure water (ion-exchanged water) | 150 ml |
| Ethylenediaminetetraacetic acid disodium salt | 2 g |
| Diethylene glycol | 50 g |
| Potassium sulfite (55% w/v aq. sol.) | 100 ml |
| Potassium carbonate | 50 g |
| Hydroquinone | 15 g |
| 1-Phenyl-5-mercaptotetrazole | 30 mg |
| Potassium hydroxide | q.s. for pH 10.4 |
| Potassium bromide | 4.5 g |
| **Formula B** | |
| Pure water (ion-exchanged water) | 3 mg |
| Diethylene glycol | 50 g |
| Ethylenediaminetetraacetic acid disodium salt | 25 mg |
| Acetic acid (90% aq. sol.) | 0.3 ml |
| 1-phenyl-3-pyrazolidone | 500 mg |

Before use, formulas A and B were successively dissolved in 500 ml of water and worked up to a total volume of 1,000 ml.

TABLE 3

| No. | Water-soluble conductive polymer (A) | Hydrophobic polymer (B) | Hardening agent (C) | Radiation | Intensity ($KW/m^2$) | Tetrazolium compound (T) | Specific surface resistance Ω I* | Specific surface resistance Ω II** | Relative sensitivity I* | Relative sensitivity II** | Remarks |
|---|---|---|---|---|---|---|---|---|---|---|---|
| 3-1 | 4 | 7 | 6 | EB | 50 | 7 | $1.3 \times 10^{10}$ | $2.5 \times 10^{10}$ | 105 | 95 | Invention |
| 3-2 | 7 | 2 | 5 | EB | 50 | 2 | $2.0 \times 10^{10}$ | $4.2 \times 10^{10}$ | 120 | 110 | Invention |
| 3-3 | 10 | 8 | 1 | EB | 50 | 11 | $1.9 \times 10^{10}$ | $3.6 \times 10^{10}$ | 110 | 100 | Invention |
| 3-4 | 12 | 12 | 9 | X-rays | 300 | 12 | $1.3 \times 10^{10}$ | $2.5 \times 10^{10}$ | 105 | 90 | Invention |
| 3-5 | 19 | 6 | 6 | X-rays | 300 | 10 | $2.2 \times 10^{10}$ | $4.0 \times 10^{10}$ | 100 | 90 | Invention |
| 3-6 | 19 | 6 | a | — | — | 10 | $2.2 \times 10^{10}$ | $2.4 \times 10^{13}$ | 100 | 20 | Comparison |

*I: Measured after storage at 23° C. × 55% r.h. for 3 days.
**II: Measured after storage in moisture-proof bag at 55° C. for 3 days following humidification at 23° C. × 55% r.h. for 3 h.
As is clear from the data in Table 3, the samples prepared in accordance with the present invention experienced less desensitization during storage and the antistatic coating used did not deteriorate so much as the comparative sample upon processing.

EXAMPLE 4

Subbed polyethylene terephthalate films were subjected to corona discharge treatment. Thereafter, antistatic coating solutions having the composition described below were applied with a roll fit coating pan and an air knife at a rate of 33 m/min to provide deposits also shown below.

| | |
|---|---|
| Water-soluble conductive polymer (A) | 0.6 $g/m^2$ |
| Hydrophobic polymer particles (B) | 0.4 $g/m^2$ |
| Polyalkylene oxide compound (Ao) | 0.04 $g/m^2$ |
| Hardener (H) | 0.1 $g/m^2$ |

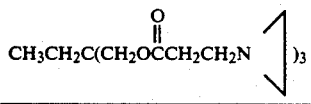

The applied antistatic coatings were dried at 90° C. for 2 min and subsequently heat-treated at 140° C. for 90 sec. After applying corona discharge onto the antistatic coatings at an energy of 30 $W/m^2$ per min, gelatin was applied to provide a deposit of 0.1 $g/m^2$. The gelatin layer was then dried at 90° C. for 2 min and subsequently heat-treated at 140° C. for 90 sec. The gelatin layer was hardened with the following hardener which was added in an amount of 30 mg per g of gelatin. The compositions of the thus prepared supports are shown in Table 4-1.

Hardener:

TABLE 4-1

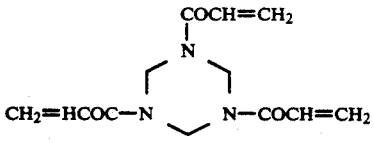

| No. | water-soluble conductive polymer (A) | hydrophobic polymer particles (B) | polyalkylene oxide (Ao) |
|---|---|---|---|
| 4-1 | 3 | 8 | 1 |
| 4-2 | 3 | 8 | 2 |
| 4-3 | 3 | 16 | 2 |
| 4-4 | 3 | 18 | 2 |
| 4-5 | 3 | 21 | 8 |
| 4-6 | 6 | 5 | 1 |
| 4-7 | 6 | 11 | 2 |
| 4-8 | 6 | 16 | 8 |
| 4-9 | 9 | 5 | 1 |
| 4-10 | 9 | 8 | 2 |
| 4-11 | 9 | 16 | 8 |
| 4-12 | 9 | 19 | 9 |

A negative-working silver halide photographic material as a roomlight handling film was prepared in the following way.

EMULSION PREPARATION

A silver chlorobromide emulsion with 2 mol % AgBr was prepared by the following procedure.

An aqueous solution containing a potassium salt of hexabromorhodium in an amount of 23.9 mg per 60 g of silver nitrate, sodium chloride and potassium bromide and an aqueous solution of silver nitrate were subjected to double-jet precipitation in an aqueous gelatin solution under stirring at 40° C. for 25 min, whereby a silver chlorobromide emulsion having an average grain size of 0.20 μm was prepared.

To this emulsion, 200 mg of 6-methyl-4-hydroxy-1,3,3a,7-tetrazaindene was added as a stabilizer and the mixture was washed with water and desalted.

To the desalted mixture, 20 mg of 6-methyl-4-hydroxy-1,3,3a,7-tetrazaindene was added, followed by sulfur sensitizaion. To each of the mixtures, the necessary amount of gelatin was added and 6-methyl-4-hydroxy-1,3,3a,7-tetrazaindene was added as a stabilizer. Subsequently, the mixtures were worked up with water to a total volume of 260 ml, whereby emulsions were prepared. Preparation of latex (L) for emulsion addition:

To 40 L of water, 0.25 kg of KMDS (sodium salt of dextran sulfate ester of Meito Sangyo Co., Ltd.) and 0.05 kg of ammonium persulfate were added. To the stirred mixture at 81° C., a mixture of n-butyl acrylate (4.51 kg), styrene (5.49 kg) and acrylic acid (0.1 kg) was added in a nitrogen atmosphere over a period of 1 n. Thereafter, 0.005 kg of ammonium persulfate was added and the mixture was stirred for 1.5 h. The stirred mixture was cooled and its pH was adjusted to 6.0 with aqueous ammonia.

The resulting latex solution was filtered through a Whatman GF/D filter and worked up with water to a volume of 50.5 kg, whereby a monodisperse latex (L) having an average grain size of 0.25 μm was prepared.

The necessary additives were added to the emulsion and a silver halide emulsion coating solution was prepared in the following way. Preparation of emulsion coating solution:

After adding 9 mg of compound (A) as a bacteriocide to the emulsion, the pH of the mixture was adjusted to 6.5 with 0.5N sodium hydroxide. Subsequently, 360 mg of compound (T) was added and, further, an aqueous solution of 20% saponin, sodium dodecylbenzenesulfonate, 5-methylbenzotriazole and latex (L) were added in respective amounts of 5 ml, 180 mg, 80 mg and 43 ml per mole of silver halide. Thereafter, 60 mg of compound (M) and 280 mg of an aqueous styrene/maleic acid copolymer (thickener) were successively added and the mixture was worked up with water to a volume of 475 ml, whereby an emulsion coating solution was prepared.

In the next step, a coating solution for an emulsion protective layer was prepared in the following way. Preparation of emulsion protective layer coating solution:

Pure water was added to gelatin present in various amounts, whereby the gelatin was swollen. After dissolving the gelatin at 40° C., a 1% aqueous solution of compound (Z) (coating aid), compound (N) (filter dye) and compound (D) were successively added, and the pH of the mixture was adjusted to 6.0 with an aqueous solution of citric acid. To the resulting solution, amorphous silica was added as a matting agent, whereby a coating solution for emulsion protective layer was prepared.

Compound (T):

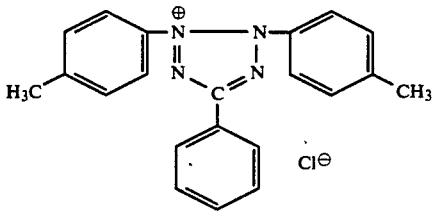

Compound (Z)

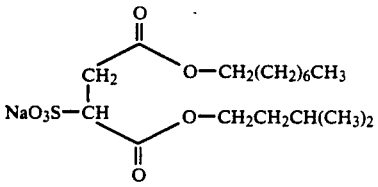

Compound (M):

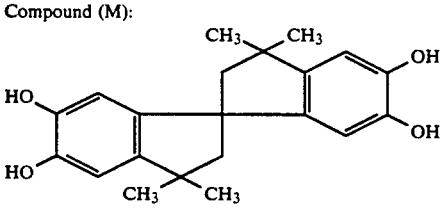

Compound (N):

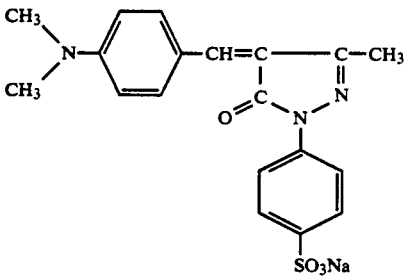

Compound (A)

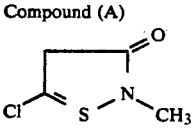

Compound (D)

-continued

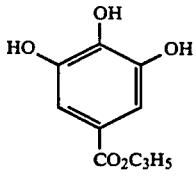

A coating solution for backing layer was then prepared in the following manner. Preparation of backing coating solution B-1: Gelatin (36 g) was swollen in water and dissolved by heating. Thereafter, an aqueous solution containing dyes (C-1), (C-2) and (C-3) in respective amounts of 1.6 g, 310 mg and 1.9 g, as well as compound (N) in an amount of 2.9 g was added to the gelatin solution. Subsequently, 11 ml of a 20% aqueous solution of saponin, 5 g of compound (C-4) as a physical property adjusting agent and 63 mg of compound (C-5) in methanol were added. To the resulting solution, 800 g of a water-soluble styrene/maleic acid copolymer was added as a thickener for viscosity adjustment, and the pH of the resulting mixture was adjusted to 5.4 with an aqueous solution of citric acid. Thereafter, a hydroxyl group containing epoxy curing agent (for its name, see Table 4-2) was added in the amount also shown in Table 4-2. Finally, 144 mg of glyoxal was added and the mixture was worked up with water to a volume of 960 ml, whereby a backing layer coating solution B-1 was prepared.

Compound (C-1):

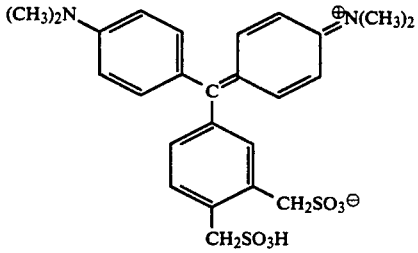

Compound (C-2):

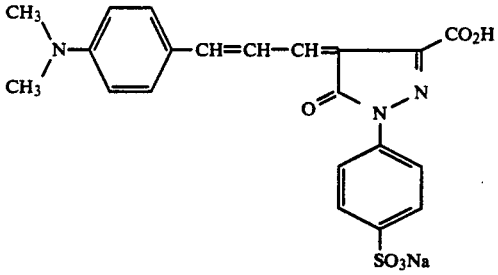

Compound (C-3):

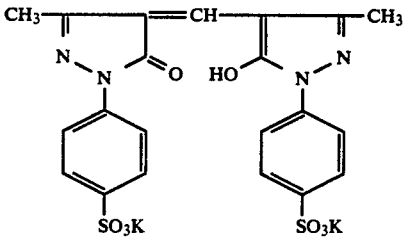

Compound (C-4):

-continued

Copolymer latex of $\left(CH_2-\underset{CO_2C_9H_9}{CH}\right)_m$ and $\left(CH_2-\overset{Cl}{\underset{Cl}{C}}\right)_n$ (m:n = 1:1)

Compound (C-5):

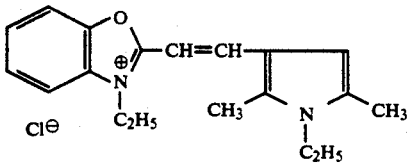

In the next step, a backing protective layer coating solution B-2 was prepared in the following way. Preparation of protective layer coating solution B-2:

Gelatin (50 g) was swollen in water and dissolved by heating. Thereafter, a solium salt of bis(2-ethylhexyl) 2-sulfosuccinate, sodium chloride, glyoxal and mucochloric acid were added in respective amounts of 340 mg, 3.4 g, 1.1 g and 540 mg. To the resulting mixture, spherical polymethyl methacrylate particles (average size = 4 μm) were added as a matting agent in an amount of 40 mg/m$^2$ and the mixture was worked up with water to a total volume of 1,000 ml, whereby a protective coating solution layer B-2 was prepared.

Preparation of Samples Under Evaluation

The supports having the antistatic coatings described in Table 4-1 were coated simultaneously with backing layer coating solution B-1 and backing protective layer coating solution B-2.

The other side of each support was subbed in accordance with Example 1 of Unexamined Published Japanese Pat. No. 19941/1984, and the emulsion coating solution and the emulsion protective layer coating solution were applied simultaneously in superposition, whereby samples A 4-2-1 TO A 4-2-13 under cvaluation were prepared. The conditions for applying and drying the emulsion layer and the emulsion protective layer were so set that the surface temperature at a water-to-gelatin weight ratio of 400% would be 17° C.

The gelatin deposits in the backing layer, backing protective layer, emulsion layer and emulsion protective layer were 2.0 g, 1.5 g, 2.0 g and 1.1 g, respectively, per square meter. The silver deposit was 3.5 g/m$^2$.

The thus prepared samples were subjected to the following tests.

(1) ADHESION TEST

For Dry Film

Using a razor blade, a grid pattern of squares were cut into the backing layer on each of the samples and an adhesive tape was applied ever the cross-hatched area. Thereafter, the tape was quickly pulled off and the percentage of the squares in the grid of backing layer that remained on each sample was determined with respsct to the bonding area of the tape.

For Processed Film

Using a gimlet-like tool sharp-pointed a grid pattern of scratches were made on the backing surface of each sample in a processing bath. The surface of the cross-hatched area was abraded and the percentage of the squares in the grid of backing layer that remained on each sample was determined.

In the adhesion test, the result was considered to be satisfactory for practical purposes when at least 80% of the squares remained intact.

(2) AGING TEST

Each of the samples was divided into two parts; one part was stored at 23° C.×55% r.h. for 3 days, and the other part was humidified at 23° C.×55% for 3 h, packed in superposition on one another in a moisture-proof bag and stored under accelerated aging conditions (at 55° C. for 3 days) to prepare aged specimens. Both types of specimens were exposed through an optical step wedge and processed with a developer and a fixing solution that had the formulations shown below. Thereafter, the sensitivity and specific surface resistance of each specimen were measured. The sensitivity was determined as the amount of exposure necessary to provide an optical density or 1.0 and expressed in terms of relative values.

The results of tests (1) and (2) are shown in Table 4-2.

PROCESSING SCHEME

| Step | Temperature (°C.) | Time (sec) |
|---|---|---|
| Development | 34 | 15 |
| Fixing | 34 | 15 |
| Washing | R.T. | 10 |
| Drying | 40 | 9 |

DEVELOPER

Formula A

| | |
|---|---|
| Pure water (ion-exchanged water) | 150 ml |
| Ethylenediaminetetraacetic acid disodium salt | 2 g |
| Diethylene glycol | 50 g |
| Potassium sulfite (55% w/v aq. sol.) | 100 ml |
| Potassium carbonate | 50 g |
| Hydroquinone | 15 g |
| 5-Methylbenzotriazole | 200 mg |
| 1-Phenyl-5-mercaptotetrazole | 30 mg |
| Potassium hydroxide | q.s. for pH 10.9 |
| Potassium bromide | 4.5 g |

Formula B

| | |
|---|---|
| Pure water (ion-exchanged water) | 3 ml |
| Diethylene glycol | 50 g |
| Ethylenediaminetetraacetic acid disodium salt | 25 mg |
| Acetic acid (90% aq. sol.) | 0.3 ml |
| 5-Nitroindazole | 110 mg |
| 1-Phenyl-3-pyrazolidone | 500 mg |

Before use, formulas A and B were successively dissolved in 500 ml of water and worked up to a total volume of 1,000 ml.

FIXING SOLUTION

Formula A

| | |
|---|---|
| Ammonium thiosulfate (72.5 w/v aq. sol.) | 230 ml |
| Sodium sulfite | 9.5 g |
| Sodium acetate ($3H_2O$) | 15.9 g |
| Boric acid | 6.7 g |
| Sodium citrate ($2H_2O$) | 2 g |

-continued

| | |
|---|---|
| Acetic acid (90% w/w aq. sol.) | 8.1 ml |

Formula B

| | |
|---|---|
| Pure water (ion-exchanged water) | 17 ml |
| Sulfuric acid (50 wt % w/w aq. sol.) | 5.8 g |
| Aluminum sulfate (aq. sol. with 8.1% w/w $Al_2O_3$) | 26.5 g |

Before use, formulas A and B were successively dissolved in 500 ml of water and worked up to a total volume of 1,000 ml. The resulting fixing solution had a pH of ca. 4.3.

The results are shown in Table 4-2.

TABLE 4-2

| No. | Support No. (See Table 4-1) | Epoxy curing agent | Dry film adhesion (%) | Processed film adhesion (%) | Specific surface resistance Ω I* | Specific surface resistance Ω II** | Relative sensitivity I* | Relative sensitivity II** | Remarks |
|---|---|---|---|---|---|---|---|---|---|
| 4-2-1 | 1 | — | 50 | 50 | $4.0 \times 10^{10}$ | $4.0 \times 10^{13}$ | 100 | 30 | Comparison |
| 4-2-2 | 1 | 1 | 80 | 80 | $4.0 \times 10^{10}$ | $6.0 \times 10^{11}$ | 100 | 90 | Invention |
| 4-2-3 | 2 | 1 | 85 | 90 | $4.0 \times 10^{10}$ | $5.0 \times 10^{11}$ | 100 | 95 | Invention |
| 4-2-4 | 3 | 1 | 80 | 85 | $3.0 \times 10^{10}$ | $5.0 \times 10^{11}$ | 100 | 90 | Invention |
| 4-2-5 | 4 | 2 | 90 | 90 | $6.0 \times 10^{10}$ | $4.0 \times 10^{11}$ | 100 | 95 | Invention |
| 4-2-6 | 5 | 2 | 95 | 90 | $5.0 \times 10^{10}$ | $5.0 \times 10^{11}$ | 100 | 90 | Invention |
| 4-2-7 | 6 | 3 | 95 | 95 | $5.0 \times 10^{10}$ | $6.0 \times 10^{11}$ | 100 | 90 | Invention |
| 4-2-8 | 7 | 4 | 90 | 90 | $6.0 \times 10^{10}$ | $6.0 \times 10^{11}$ | 100 | 95 | Invention |
| 4-2-9 | 8 | 5 | 90 | 85 | $7.0 \times 10^{10}$ | $8.0 \times 10^{11}$ | 100 | 95 | Invention |
| 4-2-10 | 9 | 6 | 85 | 90 | $8.0 \times 10^{10}$ | $8.0 \times 10^{11}$ | 100 | 95 | Invention |
| 4-2-11 | 10 | 7 | 90 | 90 | $5.0 \times 10^{10}$ | $6.0 \times 10^{11}$ | 100 | 90 | Invention |
| 4-2-12 | 11 | 8 | 90 | 95 | $4.0 \times 10^{10}$ | $4.0 \times 10^{11}$ | 100 | 90 | Invention |
| 4-2-13 | 12 | 9 | 85 | 90 | $3.0 \times 10^{10}$ | $5.0 \times 10^{11}$ | 100 | 90 | Invention |

*I: Measured at 23° C. × 20% r.h. after storage at 23° C. × 55% r.h. for 3 days.
**II: Measured at 23° C. × 20% r.h. after storage in moisture-proof bag at 55° C. for 3 days following humidification at 23° C. × 55% r.h. for 3 h.

As is clear from the data in Table 4-2, the samples prepared in accordance with the present invention were superior to the comparative sample in film adhesion under both dry and processed conditions. Further, they experienced smaller variations in specific surface resistance and sensitivity with time.

EXAMPLE 5

The procedure of Example 4 was repeated except that a hydrazine compound (HD) was used as a supercontrasty agent in place of the tetrazolium compound T. The results were the same as those obtained in Example 4. In Example 5, a developer of formula B shown below was used and development was conducted at 38° C. for 20 sec. Compound (HD):

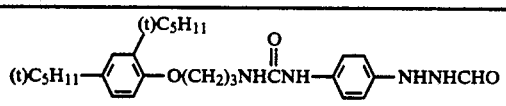

Developer B:

| | |
|---|---|
| Hydroquinone | 45.0 g |
| N-Methyl-p-aminophenol hemisulfate | 0.8 g |
| Sodium hydroxide | 15.0 g |
| Potassium hydroxide | 55.0 g |
| 5-sulfosalicyclic acid | 45.0 g |
| Boric acid | 35.0 g |
| Potassium sulfite | 110.0 g |
| Ethylenediaminetetraacetic acid disodium salt | 1.0 g |
| Potassium bromide | 6.0 g |
| 5-Methylbenzotriazole | 0.6 g |
| n-Butyl-diethanolamine | 15.0 g |

-continued

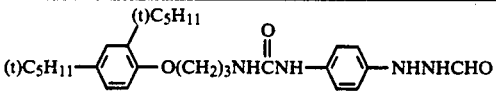

Developer B:

| | |
|---|---|
| Water | to make 1,000 ml (pH = 11.6) |

The silver halide photographic material of the present invention has an antistatic coating on a plastic film support that will not deteriorate in its antistatic capability even if it is subjected to development and other photographic processing and which yet has high crack resistance and good adhesion. Further, this photographic material is highly stable in that it will undergo little change in sensitivity and specific surface resistance over time even if a supercontrasty agent such as a tetrazolium or hydrazine compound is used.

What is claimed is:

1. A silver halide photographic element comprising a support having provided, on a first side thereof, at least one light sensitive silver halide emulsion layer containing a hydrazine compound or tetrazolium compound and, on a second side thereof, an antistatic coating layer having a backing layer formed thereon, said hydrazine compound being represented by the following formula

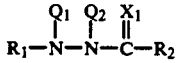

(H)

wherein $R_1$ is a monovalent organic residue; $R_2$ is hydrogen or a monovalent organic residue; $Q_1$ and $Q_2$ are each independently hydrogen, optionally substituted alkylsulfonyl, or optionally substituted arylsulfonyl; and $X_1$ is oxygen or sulfur;

said tetrazolium compound being represented by the following formula

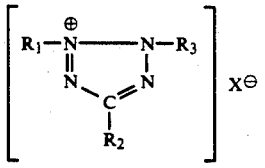

(T)

wherein $R_1$, $R_2$ and $R_3$ are each independently substituted or unsubstituted phenyl; and $X^{\ominus}$ is an anion;

said antistatic coating layer containing (1) a water soluble conductive polymer having a molecular weight of 3,000–100,000 and, in an amount of at least 5 wt % per mol of polymer, a group selected from the class consisting of sulfonic acid, sulfate ester, quaternary ammonium salt, tertiary ammonium salt, carboxyl and polyethylene oxide, (2) hydrophobic polymer particles obtained by polymerizing a monomer selected from the group consisting of styrene, a styrene derivative, alkyl acrylate, alkyl methacrylate, an olefinic derivative, a halogenated ethylene derivative, an acrylamide derivative, a methacrylamide derivative, a vinyl ester derivative, and acrylonitrile, and (3) an electron-beam or an X-ray radiation curable polyalkylene oxide compound or a polyfunctional aziridine compound in an amount of 1–1,000 mg/m$^2$; said backing layer containing gelatin as a binder and an aliphatic epoxy curing agent having a hydroxyl group and a plurality of epoxy groups in an amount of 1–1,000 mg/m$^2$.

2. The element of claim 1 wherein said polyalkylene oxide compound is represented by the following general formula (C):

$$CH_2{=}CH{-}L{-}CH{=}CH_2 \qquad (C)$$

wherein L is a substituted or unsubstituted alkylene oxide chain.

3. The element of claim 1 wherein said polyalkylene oxide compound contained in said antistatic coating layer is cured by exposure to electron beams or X-rays at an energy of $10^{-2}$ to $10^{6}$ kW/m$^2$.

4. The element according to claim 1 wherein the water-soluble conductive polymer has at least one conductive group selected from among a sulfonic acid group, a sulfate ester group, and a quarternary ammonium salt group.

5. The element according to claim 1 wherein the antistatic coating contains the water-soluble conductive polymer in an amount of 0.01–10 g/m$^2$.

6. The element according to claim 1 wherein the hydrazine compound is contained in the light-sensitive emulsion layer in an amount of $10^{-5}$ to $10^{-1}$ mole per mole of silver.

7. The element according to claim 1 wherein the tetrazolium compound is contained in the light-sensitive emulsion layer in an amount of from about 1 mg up to 10 g per mole of silver halide.

* * * * *